US006988876B2

(12) United States Patent
Ke et al.

(10) Patent No.: US 6,988,876 B2
(45) Date of Patent: Jan. 24, 2006

(54) SCROLL TYPE FLUID MACHINERY

(76) Inventors: Enjiu Ke, 1545 Quellete Ave., Apt. 802, Windsor, Ontario (CA) N8X 1K6; Ji Ke, 1545 Quellete Ave., Apt. 802, Windsor, Ontario (CA) N8X 1K6

( * ) Notice: Subject to any disclaimer, the term of this patent is extended or adjusted under 35 U.S.C. 154(b) by 0 days.

(21) Appl. No.: 10/861,427

(22) Filed: Jun. 7, 2004

(65) Prior Publication Data

US 2004/0219047 A1 Nov. 4, 2004

Related U.S. Application Data

(63) Continuation of application No. PCT/CA03/01655, filed on Nov. 4, 2003, which is a continuation of application No. 10/287,042, filed on Nov. 4, 2002, now abandoned.

(51) Int. Cl.
*F04C 18/00* (2006.01)

(52) U.S. Cl. ..... 418/60; 418/55.3; 418/55.1; 418/150; 464/102

(58) Field of Classification Search ..... 418/55.1, 418/55.2, 55.3, 60, 150, 102; 464/102
See application file for complete search history.

(56) References Cited

U.S. PATENT DOCUMENTS

| | | | | |
|---|---|---|---|---|
| 801,182 A | | 10/1905 | Creux | |
| 3,011,694 A | | 12/1961 | Audemar | |
| 4,424,010 A | * | 1/1984 | McCullough | 418/60 |
| 4,515,539 A | | 5/1985 | Morishita | |
| 4,553,913 A | | 11/1985 | Morishita et al. | |
| 4,990,071 A | | 2/1991 | Sugimoto | |
| 5,304,047 A | | 4/1994 | Shibamoto | |
| 5,690,480 A | | 11/1997 | Suzuki et al. | |
| 5,755,564 A | | 5/1998 | Machida et al. | |
| 5,775,893 A | | 7/1998 | Takao et al. | |
| 6,123,529 A | * | 9/2000 | Kawano et al. | 418/55.1 |
| 6,267,572 B1 | | 7/2001 | Suefuji et al. | |
| 6,450,791 B1 | * | 9/2002 | Kawabata et al. | 418/55.1 |

FOREIGN PATENT DOCUMENTS

| | | |
|---|---|---|
| DE | 195 28 070 A1 | 2/1997 |
| EP | 0 846 843 A | 6/1998 |

(Continued)

*Primary Examiner*—Theresa Trieu
(74) *Attorney, Agent, or Firm*—Corowell & Moring

(57) ABSTRACT

A scroll type fluid machinery includes first and second fluid volume changing mechanisms. The first fluid volume changing mechanism includes a first stationary scroll and a first orbiting scroll, and the first orbiting scroll is associated with the first stationary scroll so that the first orbiting scroll is able to orbit with respect to the first stationary scroll. The second fluid volume changing mechanism includes a second stationary scroll and a second orbiting scroll, and the second orbiting scroll is associated with the second stationary scroll so that the second orbiting scroll is able to orbit with respect to the second stationary scroll. The scroll type fluid machinery further includes a plurality of orbiting units. Each of the orbiting units includes a rotating member that is able to rotate relative to the first and second stationary scrolls, and a thrust-canceling shaft connected to the first orbiting scroll and to the second orbiting scroll. The thrust-canceling shaft is eccentrically and rotatably supported in the rotating member, and the orbiting units are arranged to form one or more parallelogram linkages for preventing the first and second orbiting scrolls from self-rotation. One or more orbiting units are used to transmit a driving force to or from the first and the second fluid volume changing mechanisms.

26 Claims, 23 Drawing Sheets

FOREIGN PATENT DOCUMENTS

| | | | |
|---|---|---|---|
| EP | 1 101 943 A | | 5/2001 |
| JP | 60-053601 | | 3/1985 |
| JP | 04-121474 | | 4/1992 |
| JP | 05-052189 | | 3/1993 |
| JP | 05141367 A | * | 6/1993 |
| JP | 2002 174186 A | | 6/2002 |

* cited by examiner

SCROLL TYPE FLUID MACHINERY

This application is a continuation of international application PCT/CA03/01655, designating the United States and filed Nov. 4, 2003, and U.S. application Ser. No. 10/287,042, filed Nov. 4, 2002 now abandoned, the disclosures of which are expressly incorporated by reference herein.

BACKGROUND OF THE INVENTION

The present invention relates to a scroll type fluid machinery, which can be used as compressors, vacuum pumps, expansionary machines, etc.

A regular scroll type fluid machinery usually consists of a casing, a stationary scroll fixed on the casing, a driving crankshaft rotatably supported on the casing with bearings, and an orbiting scroll driven by the crankshaft. The orbiting scroll is constrained by an anti-self-rotating mechanism to realize an orbiting movement with respect to the stationary scroll. The volumes formed between the stationary scroll and the orbiting scroll change with the orbiting movement of the orbiting scroll, and the changing volumes compress the fluid in the volumes. The thrust force generated by the fluid pressure exerts on the orbiting scroll, and passes to a thrust bearing.

In order to reduce the energy consumed by the friction force on the thrust bearing, a double orbiting scroll structure was proposed. These two orbiting scrolls are mounted back-to-back to cancel the thrust force. This structure has been described in U.S. Pat. Nos. 801,812, 3,011,694, and 4,990,071.

There are two approaches for providing the driving force in the aforementioned patents. One approach is to make the driving shaft shun the stationary scroll and to input the driving force through some driving mechanisms surrounding the periphery of the orbiting scroll. The other approach is to make the crankshaft go through the center of the stationary scroll to drive the back-to-back orbiting scrolls.

The first approach greatly increases the size of the machine because the driving shaft must be mounted on the outside surrounding the stationary scroll. The second approach reduces the volume compression ratio of the fluid machinery because the driving device occupies the central portion of the orbiting scroll, which is vitally important to the compression ratio.

Another structure used to cancel the thrust force can be found in U.S. Pat. Nos. 4,515,539 and 6,267,572B1, and Japanese Patent Document 04-121,474. Two mirror-imaged orbiting scrolls are connected to the two ends of a thrust-canceling shaft, which is rotatably fitted into an eccentric through-hole in a motor shaft. To prevent the orbiting scroll from self-rotation, a mechanism is specially provided. Furthermore, the relatively weak stiffness of the orbiting scroll is caused by the fact that the orbiting scroll is supported by only one thrust canceling shaft, thus affecting the efficiency of the compressors.

SUMMARY OF THE INVENTION

An object of the present invention is to improve the performance, efficiency, and reliability of the scroll type fluid machinery. According to one aspect of the present invention, the scroll type fluid machinery comprises two housings, two stationary scrolls, two orbiting scrolls, and three orbiting units. The two housings are connected with each other. Each of the two stationary scrolls is fixed to the housings. The two stationary scrolls have an end plate and a spiral wrap extending from the end plate. Each of the two orbiting scrolls has an end plate and a spiral wrap extending from the end plate. The two orbiting scrolls are assembled with the two stationary scrolls, respectively. The three orbiting units are located between the two orbiting scrolls. Each of the three orbiting units comprises a rotating member rotatably supported on the two housings through two bearings, a thrust-canceling shaft rotatably supported in an eccentric through-hole in the rotating member through two bearings. Each thrust-canceling shaft is fixed between the two orbiting scrolls. The three orbiting units, the two orbiting scrolls, and the two housings compose three parallelogram linkages that form an anti-self-rotating mechanism. When one or more of the rotating members are driven, the orbiting scrolls orbit in the same radius with respect to the stationary scrolls to change the fluid volumes. Most of the thrusting force on the two orbiting scrolls generated by fluid pressure is canceled by the three thrust-canceling shafts, and the rest is withstood by the bearings in the orbiting units. Due to even loading among the three orbiting units, all three rotating members are driven.

It is also possible to use two orbiting units. In this case, the two rotating members of the two orbiting units can be driven by two motors. Otherwise, a synchronous device, such as synchronous belt or gears, can be used.

DETAILED DESCRIPTION OF THE INVENTION

Figure 1:
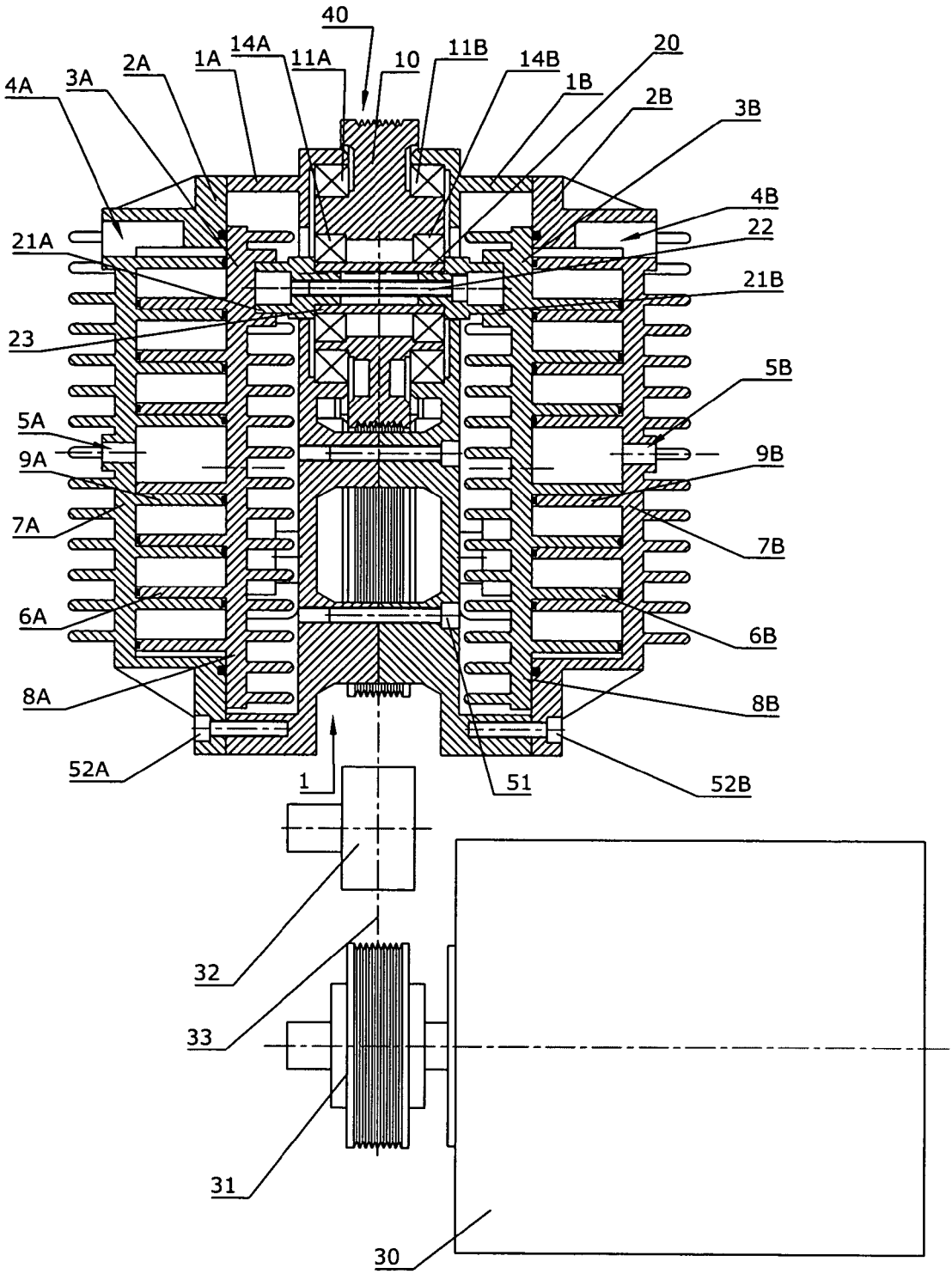
FIG. 1 is a schematic sectional view of a scroll compressor according to a first embodiment of the present invention.
Figure 2:
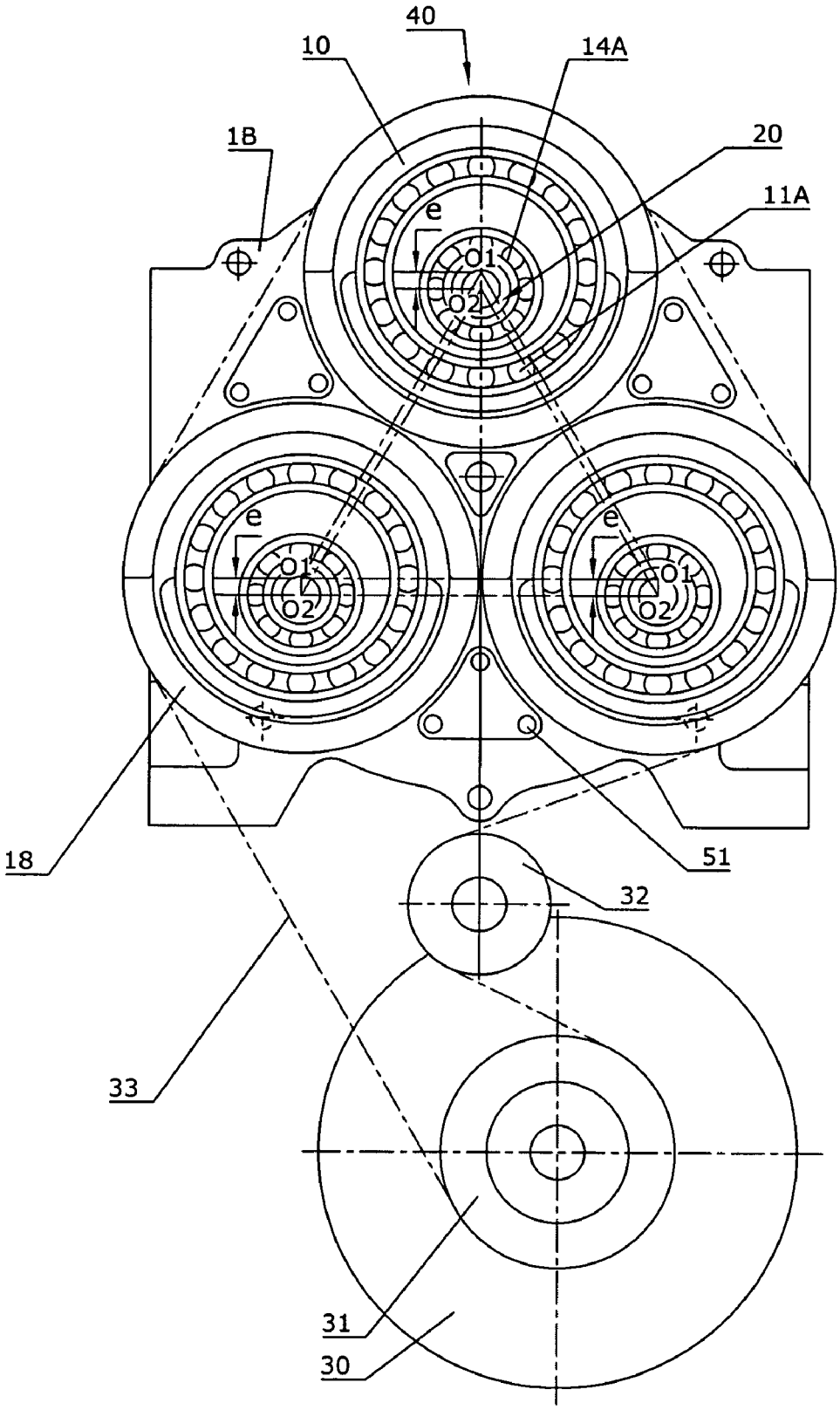
FIG. 2 is a left view of the machine shown in FIG. 1, excluding the left stationary scroll, the left orbiting scroll, and the left housing.
Figure 3:
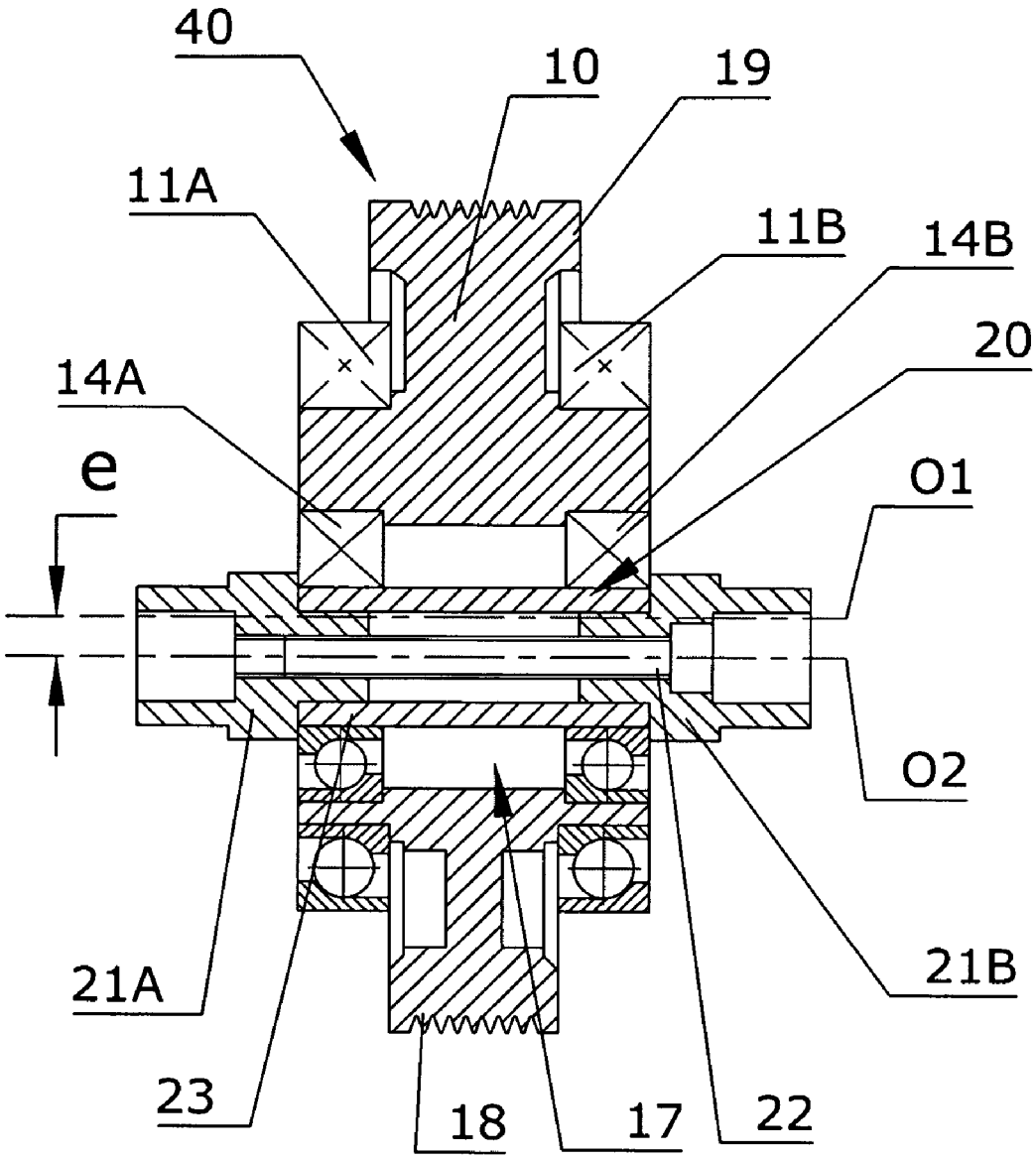
FIG. 3 is a schematic sectional view of an orbiting unit of the machine shown in FIG. 1.

FIG. 1 is a schematic sectional view of a scroll compressor according to the first embodiment of the present invention. FIG. 2 is a left view of the compressor excluding its left stationary scroll and left orbiting scroll and left housing. FIG. 3 is a schematic sectional view of an orbiting unit of the compressor. As shown in FIGS. 1–3, a left housing 1A and a right housing 1B are mounted in a mirror-image relationship through screws 51 to form a housing 1. A left stationary scroll 2A is connected to the left housing 1A through screws 52A, and a right stationary scroll 2B is connected to the right housing 1B through screws 52B. The two housings 1A and 1B, the two stationary scrolls 2A and 2B compose the fixed structure of this machine. The two stationary scrolls 2A and 2B comprise, respectively, their own end plates 7A and 7B and spiral wraps 9A and 9B extending from the corresponding end plates 7A and 7B. The scroll compressor includes two suction ports 4A and 4B that are connected, and two discharge ports 5A and 5B that are also connected. Two orbiting scrolls 3A and 3B comprise, respectively, their own end plates 8A and 8B and spiral wraps 6A and 6B extending from the corresponding end plates 8A and 8B. Furthermore, the directions of the spiral wraps 6A and 6B should be arranged in a mirror-image relationship, and the directions of the spiral wraps 9A and 9B should be arranged in a mirror-image relationship. Three orbiting units 40 are mounted between the two orbiting scrolls 3A and 3B. Each of the three orbiting units 40 comprises a rotating member 10 rotatably supported on the two housings 1A and 1B through two bearings 11A and 11B, and a thrust-canceling shaft 20 rotatably supported in the rotating member 10 by two bearings 14A and 14B. The rotating member 10 comprises a balancing weight 19, a pulley 18 located on the periphery of the rotating member 10, and an eccentric through-hole 17. The rotating axis O2 of the thrust-canceling shaft 20 is eccentric from the rotating axis O1 of the rotating member 10 with a distance of e. The three thrust-canceling shafts 20 are fixed between the two orbiting scrolls 3A and 3B. As shown in FIG. 2, the triangle defined by O1-O1-O1 is identical to the triangle defined by O2-O2-O2. The three orbiting units 40, the two orbiting scroll 3A and 3B, and the two housings 1A and 1B compose three parallelogram linkages which form an anti-self-rotating mechanism. Each thrust-canceling shaft 20 comprises a left end 21A, a right end 21B, a sleeve 23, and a bearing pre-loading screw 22. The length of the sleeve 23 should be set such that the two ends 21A and 21B contact the sleeve 23 with proper preload when the bearings 14A and 14B are properly preloaded by the bearing preloading screw 22. The three pulleys 18 are driven by a pulley 31 of a motor 30. A pre-tensioning pulley 32 is used to increase the wrap angles on the three pulleys 18 and the pulley 31 of the motor 30 and to apply proper pre-tension to a belt 33. The orbiting scrolls 3A and 3B get a much more even driving force from the three rotating member 10, and this makes the operation of the machine smoother and more reliable. When the orbiting scrolls 3A and 3B orbit, the volumes formed by the spiral wraps 9A, 9B and 6A, 6B of the stationary scrolls 2A and 2B and the orbiting scrolls 3A and 3B are continuously changed, fluid introduced through the suction ports 4A and 4B is continuously compressed, and finally the compressed fluid is discharged through the discharge ports 5A and 5B. During the process of compression, the fluid generates thrusting force exerted on the end plates 8A and 8B of the orbiting scrolls 3A and 3B. Most of the thrusting force is canceled through the three thrust-canceling shafts 20, and the rest is withstood by the bearings 11A, 11B, 14A, and 14B in the orbiting units 40. The frictional consumption of power is reduced because of the cancellation of the axial thrusting force, resulting in a high efficiency.

Figure 4:
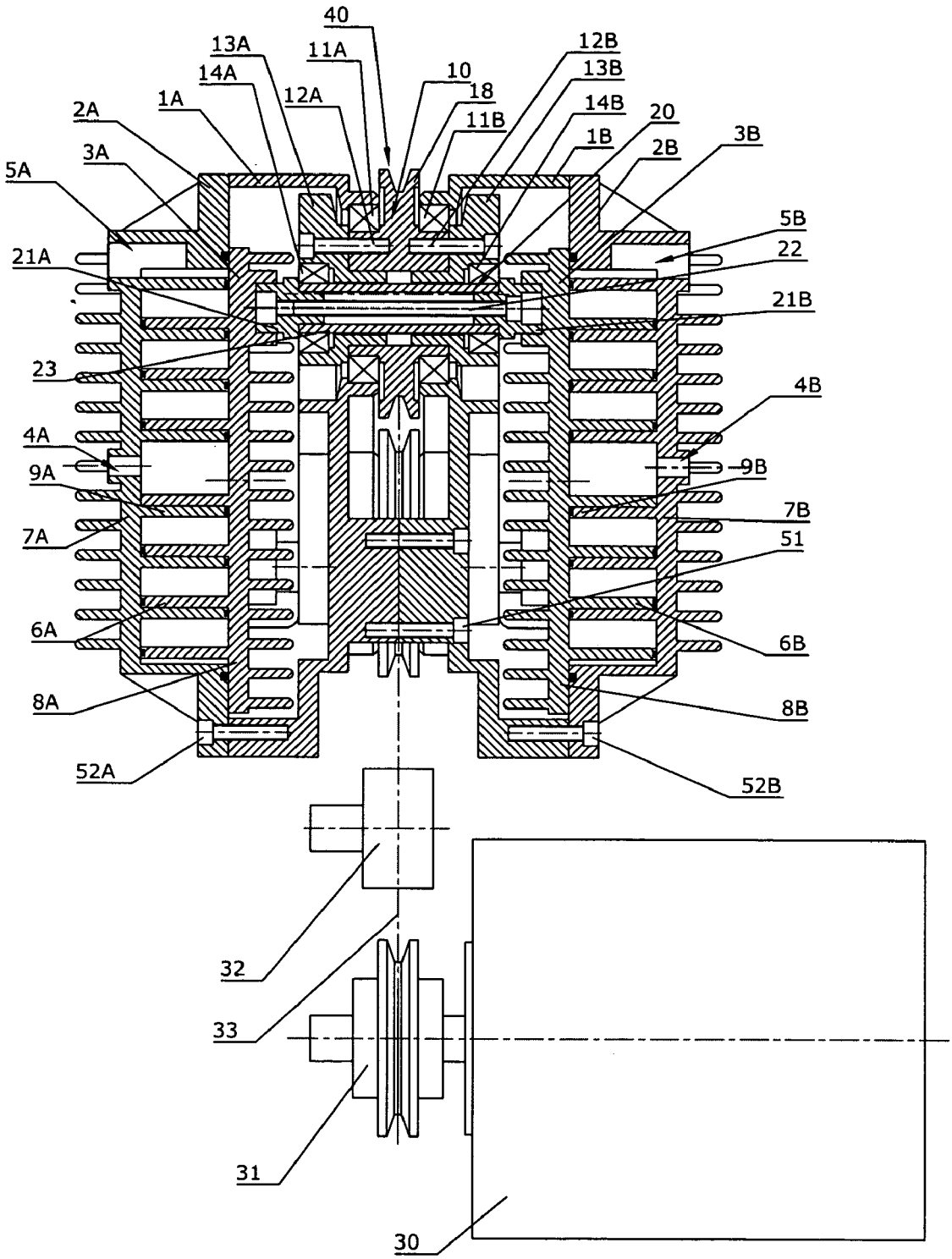
FIG. 4 is a schematic sectional view of a scroll expander according to a second embodiment of the present invention.
Figure 5:
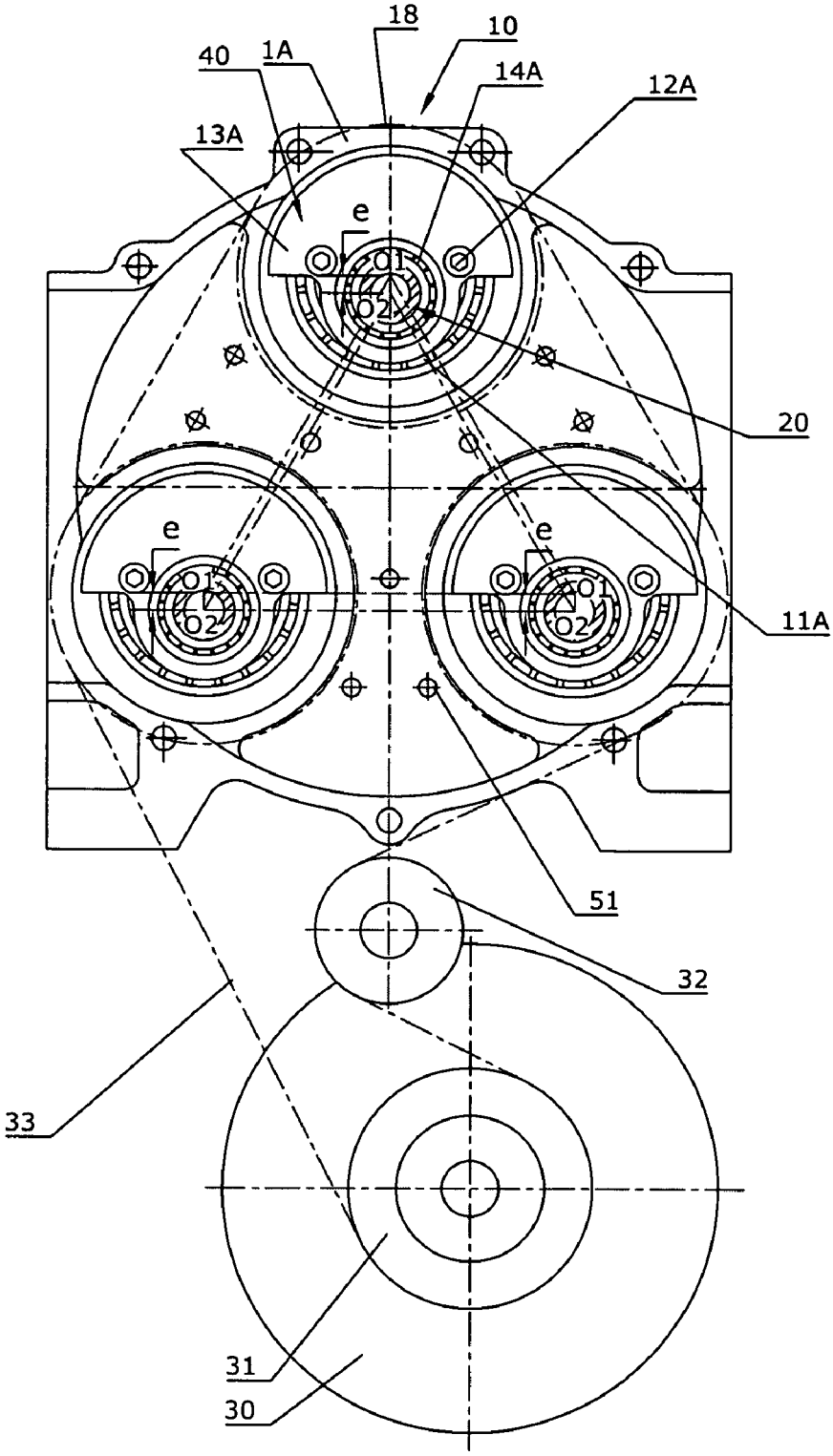
FIG. 5 is a left view of the machine shown in FIG. 4, excluding the left stationary scroll and left orbiting scroll.
Figure 6:
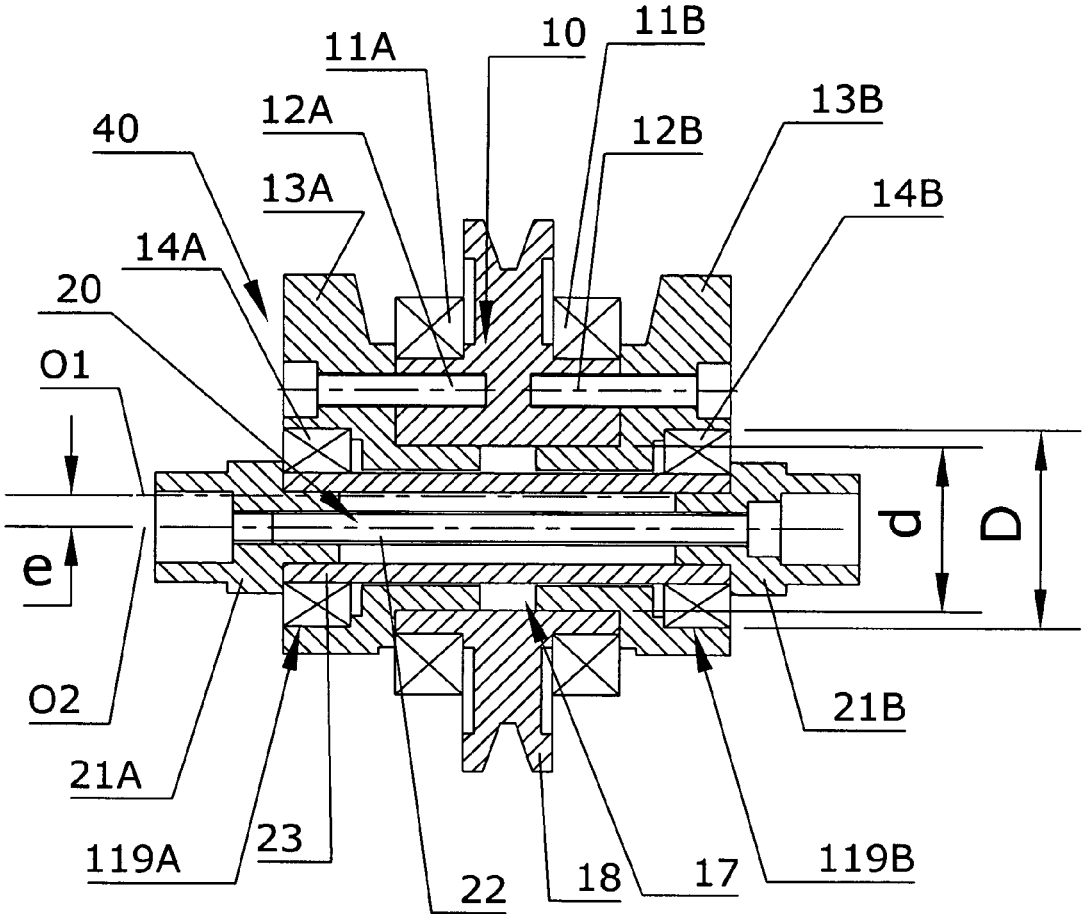
FIG. 6 is a schematic sectional view of an orbiting unit of the machine shown in FIG. 4.

FIG. 4 is a schematic sectional view of a scroll expander according to the second embodiment of the present invention. FIG. 5 is a left view of the scroll expander, excluding its left stationary scroll and left orbiting scroll. FIG. 6 is a schematic sectional view of an orbiting unit of the scroll expander. As shown in FIGS. 4–6, a left housing 1A and a right housing 1B are mounted in a mirror-image relationship through screws 51. A left stationary scroll 2A is connected to the left housing 1A through screws 52A, and a right stationary scroll 2B is connected to the right housing 1B through screws 52B. The two housings 1A and 1B, the two stationary scrolls 2A and 2B compose the fixed structure of this machine. The two stationary scrolls 2A and 2B comprise, respectively, their own end plates 7A and 7B and spiral wraps 9A and 9B extending from the corresponding end plates 7A and 7B. The scroll expander includes two suction ports 4A and 4B that are connected, and two discharge ports 5A and 5B that also are connected. Two orbiting scrolls 3A and 3B comprise, respectively, their own end plates 8A and 8B and spiral wraps 6A and 6B extending from the corresponding end plates 8A and 8B. Furthermore, the directions of the spiral wraps 6A and 6B should be arranged in a mirror-image relationship, and the directions of the spiral wraps 9A and 9B should be arranged in a mirror-image relationship. Three orbiting units 40 are mounted between the two orbiting scrolls 3A and 3B. Each of the three orbiting units 40 comprises a rotating member 10 rotatably supported on the two housings 1A and 1B through two bearings 11A and 11B, and a thrust-canceling shaft 20 rotatably supported in the rotating member 10 by two bearings 14A and 14B. The rotating member 10 comprises a pulley 18 with an eccentric through-hole 17 of diameter d, two balancing weights 13A and 13B fitted in the eccentric through-hole 17 through screws 12A and 12B, two holes 119A and 119B of diameter D being, respectively, in the two balancing weights 13A and 13B. The bearings 14A and 14B are fitted in the holes 119A and 119B, respectively, to support the thrust-canceling shaft 20. The diameter D may be made larger than the diameter d so that larger spaces can be provided for the bearings 14A and 14B. The rotating axis O2 of the thrust-canceling shaft 20 is eccentric from the rotating axis O1 of the rotating member 10 with a distance of e. The three thrust-canceling shafts 20 are fixed between the two orbiting scrolls 3A and 3B. As shown in FIG. 5, the triangle defined by O1-O1-O1 is identical to the triangle defined by O2-O2-O2. The three orbiting units 40, the two orbiting scroll 3A and 3B, and the two housings 1A and 1B compose three parallelogram linkages which form an anti-self-rotating mechanism. Each thrust-canceling shaft 20 comprises a left end 21A, a right end 21B, a sleeve 23, and a bearing pre-loading screw 22. The length of the sleeve 23 should be set such that the two ends 21A and 21B contact the sleeve 23 with proper preload when the bearings 14A and 14B are properly preloaded by the bearing preloading screw 22. A pulley 31 of a generator 30 is driven by the three pulleys 18 through a belt 33. A pre-tensioning pulley 32 is used to increase the wrap angles on the three pulleys 18 and the pulley 31 of the generator 30 and to apply proper pre-tension to the belt 33. The orbiting scrolls 3A and 3B provide a more even driving force to the three rotating members 10, and this makes the operation of the machine smoother and more reliable. When the orbiting scrolls 3A and 3B orbit, the volumes formed by the spiral wraps 9A, 9B and 6A, 6B of the stationary scrolls 2A and 2B and the orbiting scrolls 3A and 3B are continuously changed, fluid introduced through the suction ports 4A and 4B is continuously expanded, and finally the expanded fluid is discharged through the discharge ports 5A and 5B. During the process, the fluid generates thrusting force exerted on the end plates 8A and 8B of the orbiting scrolls 3A and 3B. Most of the thrusting force is canceled through the three thrust-canceling shafts 20, and the rest is withstood by the bearings 11A, 11B, 14A, and 14B in the orbiting units 40. The frictional consumption of power is reduced because of the cancellation of the axial thrusting force, resulting in a high efficiency.

Figure 7:
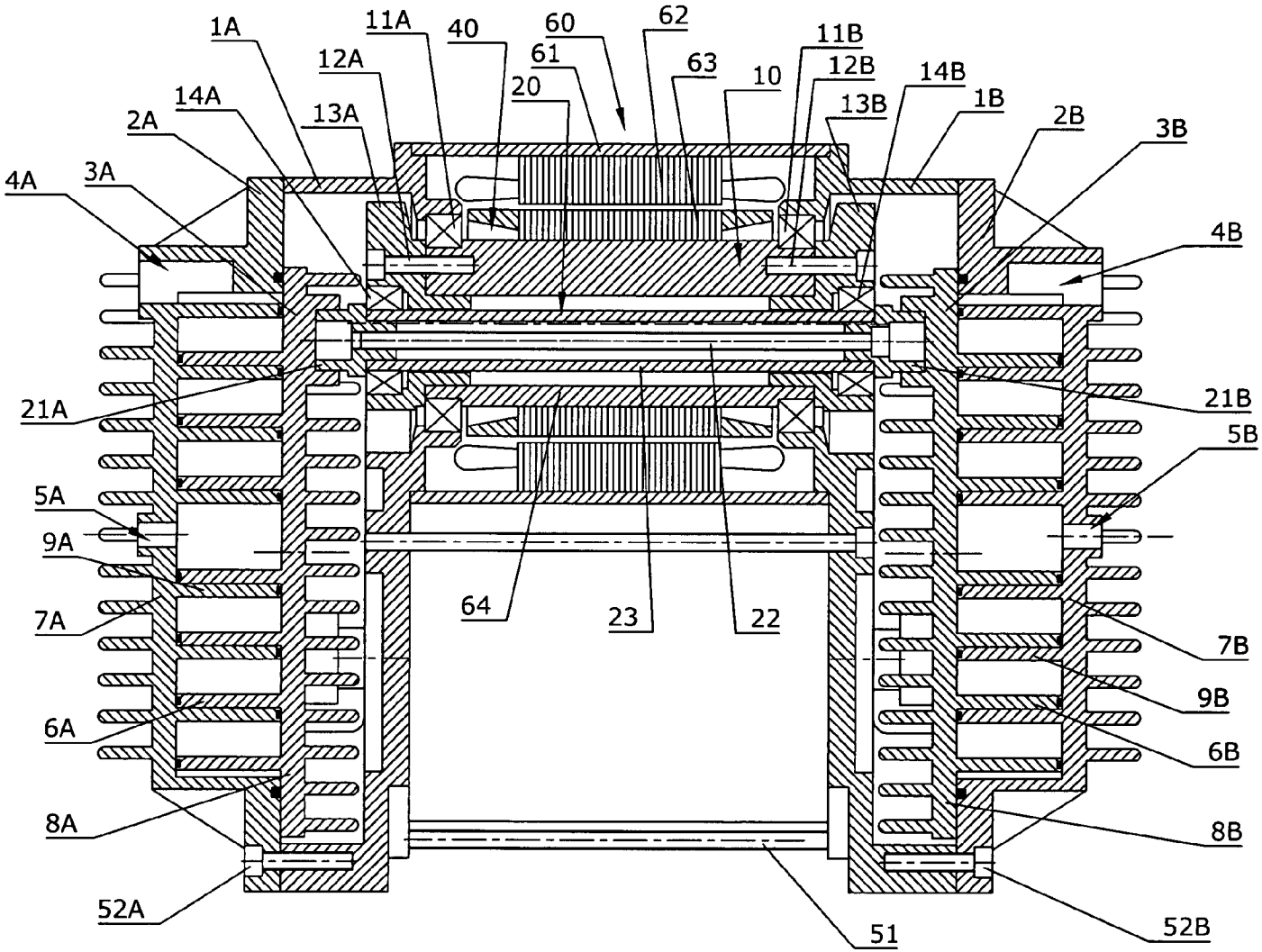
FIG. 7 is a schematic sectional view of a scroll compressor according to a third embodiment of the present invention.
Figure 8:
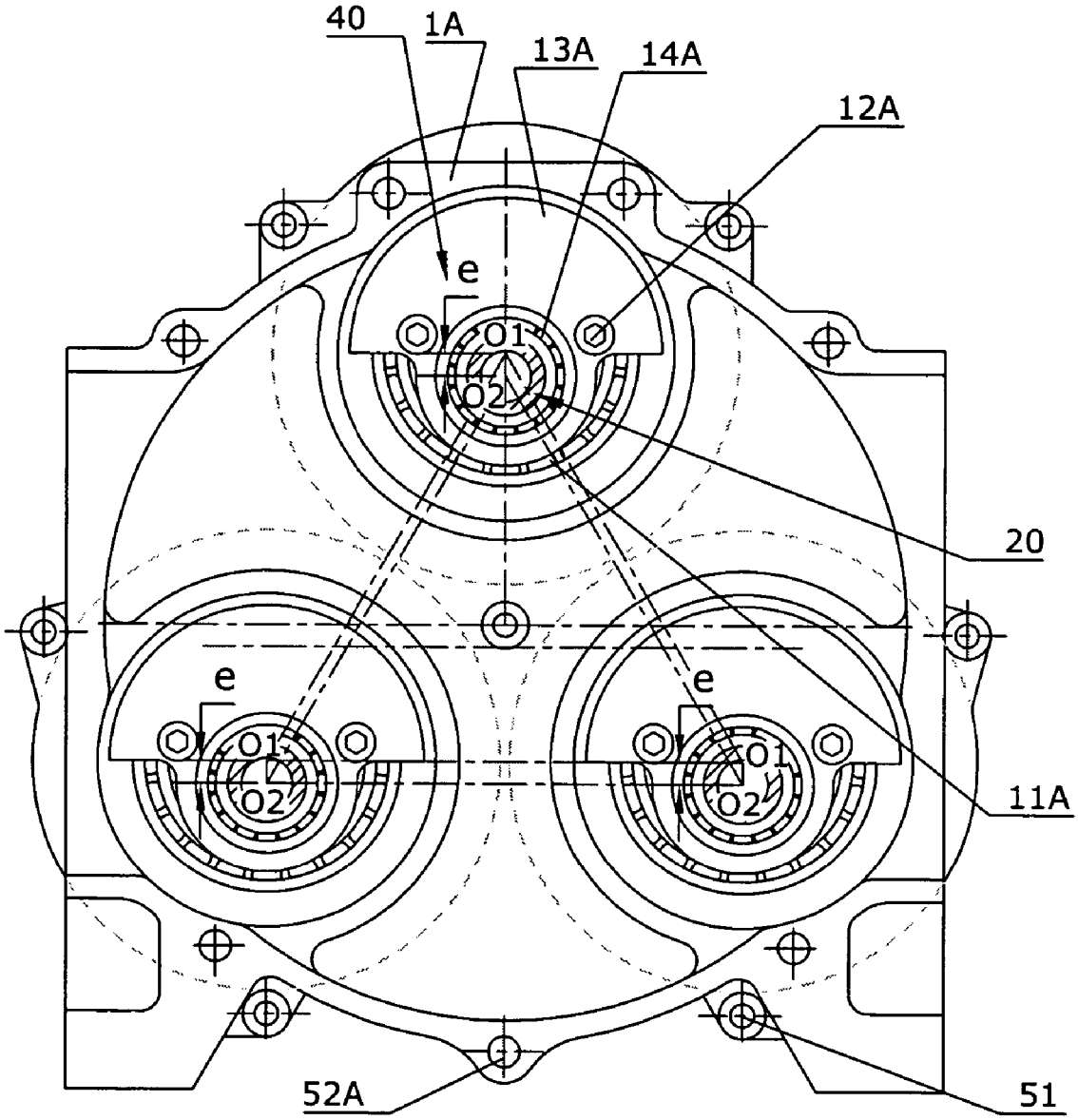
FIG. 8 is a left view of the machine shown in FIG. 7, excluding the left stationary scroll and left orbiting scroll.
Figure 9:
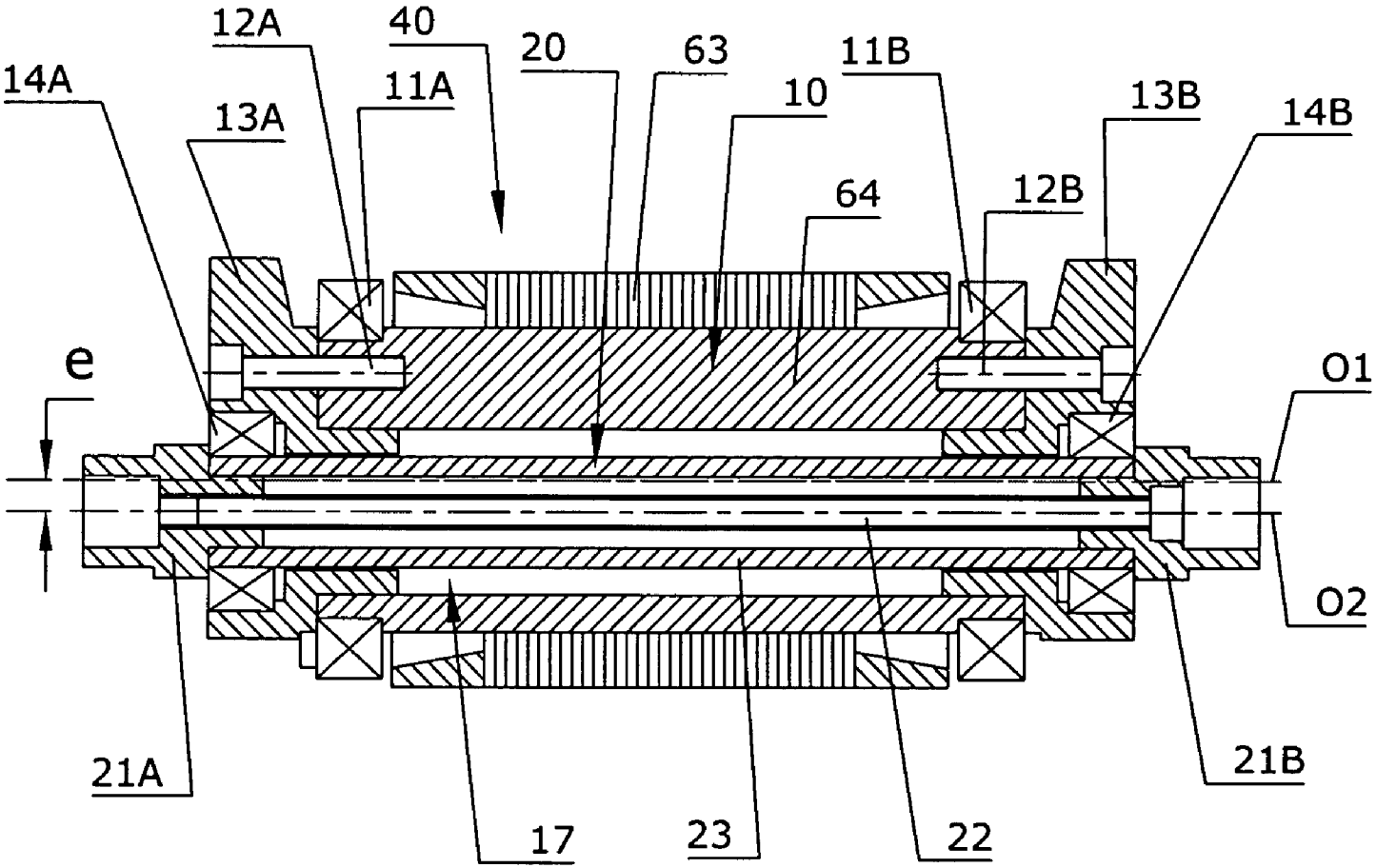
FIG. 9 is a schematic sectional view of an orbiting unit of the machine shown in FIG. 7.

FIG. 7 is a schematic sectional view of a scroll compressor according to the third embodiment of the present invention. FIG. 8 is the left view of the compressor excluding its left stationary scroll and left orbiting scroll. FIG. 9 is a schematic sectional view of an orbiting unit of the compressor. As shown in FIGS. 7–9, the compressor includes a motor 60 for driving each orbiting unit. Each motor 60 includes a shell 61, which is fixed between two housings 1A and 1B, with the stator 62 of the motor 60 fixed in the shell 61. The left housing 1A and the right housing 1B are mounted in a mirror-image relationship through screws 51. A left stationary scroll 2A is connected to the left housing 1A through screws 52A, and a right stationary scroll 2B is connected to the right housing 1B through screws 52B. The two housings 1A and 1B, the two stationary scrolls 2A and 2B, and the shells 61 with the stators 62 compose the fixed structure of this machine. The two stationary scrolls 2A and 2B comprise, respectively, their own end plates 7A and 7B and spiral wraps 9A and 9B extending from the corresponding end plates 7A and 7B. The compressor includes two suction ports 4A and 4B that are connected, and two discharge ports 5A and 5B that are connected. Two orbiting scrolls 3A and 3B comprise, respectively, their own end plates 8A and 8B and spiral wraps 6A and 6B extending from the corresponding end plates 8A and 8B. Furthermore, the directions of the spiral wraps 6A and 6B should be arranged in a mirror-image relationship, and the directions of the spiral wraps 9A and 9B should be arranged in a mirror-image relationship. Three orbiting units 40 are mounted between the two orbiting scrolls 3A and 3B. Each of the three orbiting units 40 comprises a rotating member 10 rotatably supported on the two housings 1A and 1B through two bearings 11A and 11B, and a thrust-canceling shaft 20 rotatably supported in the rotating member 10 by two bearings 14A and 14B. The rotating member 10 comprises a hollow shaft 64 of the motor 60 with an eccentric through-hole 17, a motor rotor 63 fixed on the hollow shaft 64, and two balancing weights 13A and 13B fitted in the eccentric through-hole 17 through screws 12A and 12B. The bearings 14A and 14B are fitted in the balancing weights 13A and 13B, respectively, to support the thrust-canceling shaft 20. The rotating axis O2 of the thrust-canceling shaft 20 is eccentric from the rotating axis O1 of the hollow shaft 64 with a distance of e. The three thrust-canceling shafts 20 are fixed between the two orbiting scrolls 3A and 3B. As shown in FIG. 8, the triangle defined by O1-O1-O1 is identical to the triangle defined by O2-O2-O2. The three orbiting units 40, the two orbiting scrolls 3A and 3B, and the two housings 1A and 1B compose three parallelogram linkages which form an anti-self-rotating mechanism. Each thrust-canceling shaft 20 comprises a left end 21A, a right end 21B, a sleeve 23, and a bearing pre-loading screw 22. The length of the sleeve 23 should be set such that the two ends 21A and 21B contact the sleeve 23 with proper preload when the bearings 14A and 14B are properly preloaded by the bearing pre-loading screw 22. The orbiting scrolls 3A and 3B get a much more even driving force from the three motors 60, and this makes the operation of the machine smoother and more reliable. When the orbiting scrolls 3A and 3B orbit, the volumes formed by the spiral wraps 9A, 9B and 6A, 6B of the stationary scrolls 2A and 2B and the orbiting scrolls 3A and 3B are continuously changed, fluid introduced through the suction ports 4A and 4B is continuously compressed, and finally the compressed fluid is discharged through the discharge ports 5A and 5B. During the process of compression, the fluid generates thrusting force exerted on the end plates 8A and 8B of the orbiting scrolls 3A and 3B. Most of the thrusting force is canceled through the three thrust-canceling shafts 20, and the rest is withstood by the bearings 11A, 11B, 14A, and 14B in the orbiting units 40. The frictional consumption of power is reduced because of the cancellation of the axial thrusting force, resulting in a high efficiency.

Figure 10:
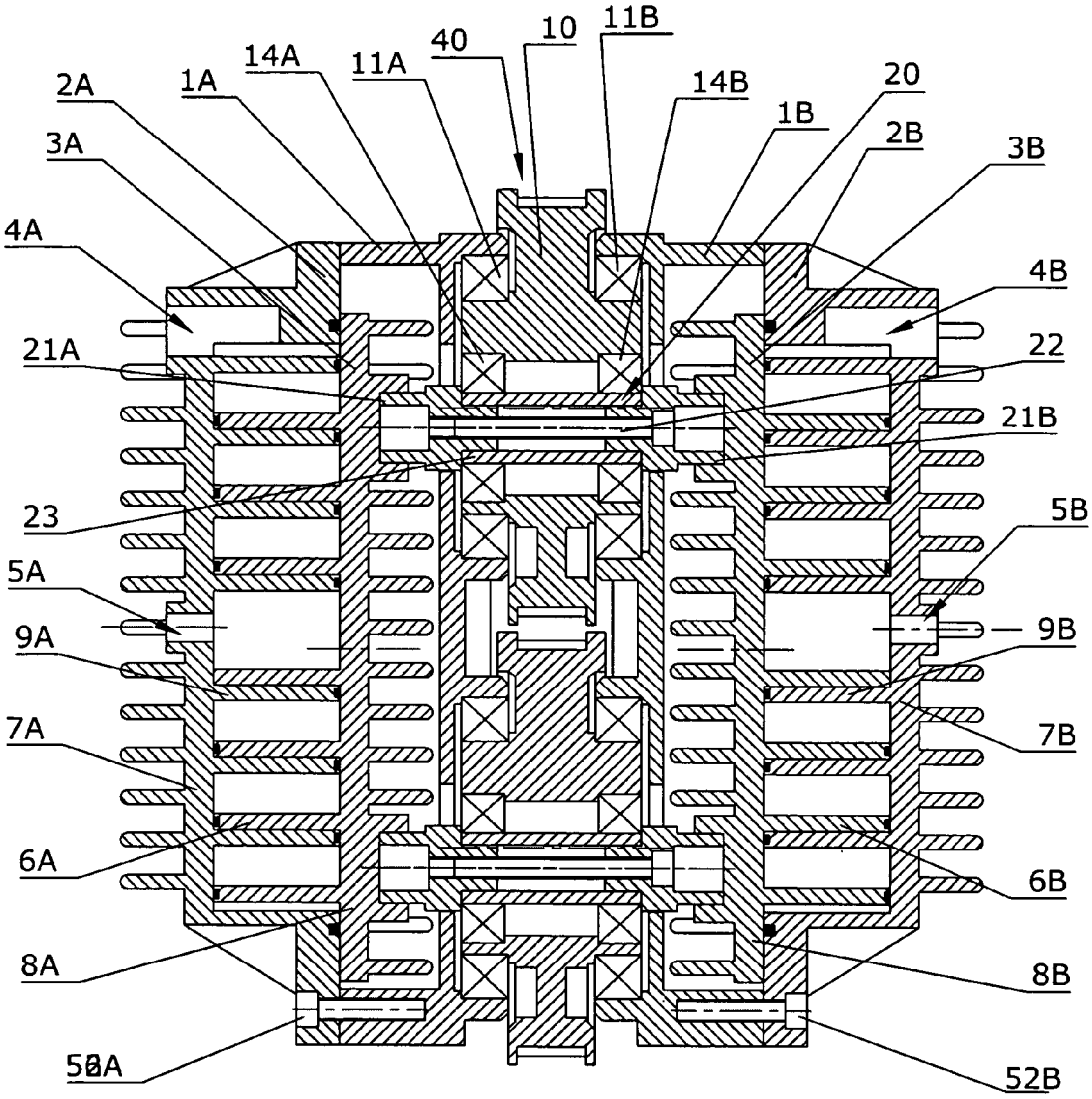
FIG. 10 is a schematic sectional view of a scroll compressor according to a fourth embodiment of the present invention.
Figure 11:
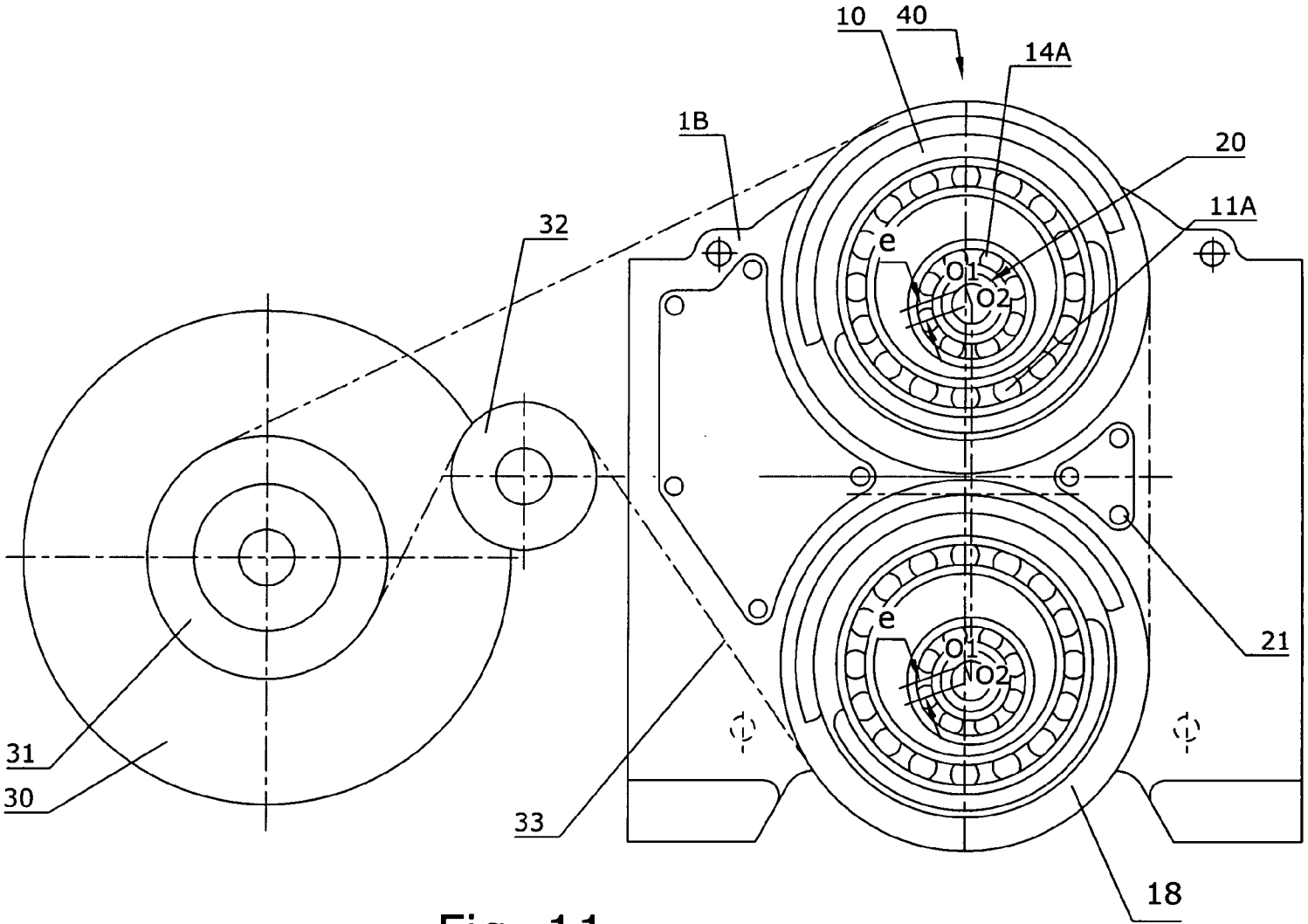
FIG. 11 is a left view of the machine shown in FIG. 10, excluding the left stationary scroll, left orbiting scroll, and left housing.
Figure 12:
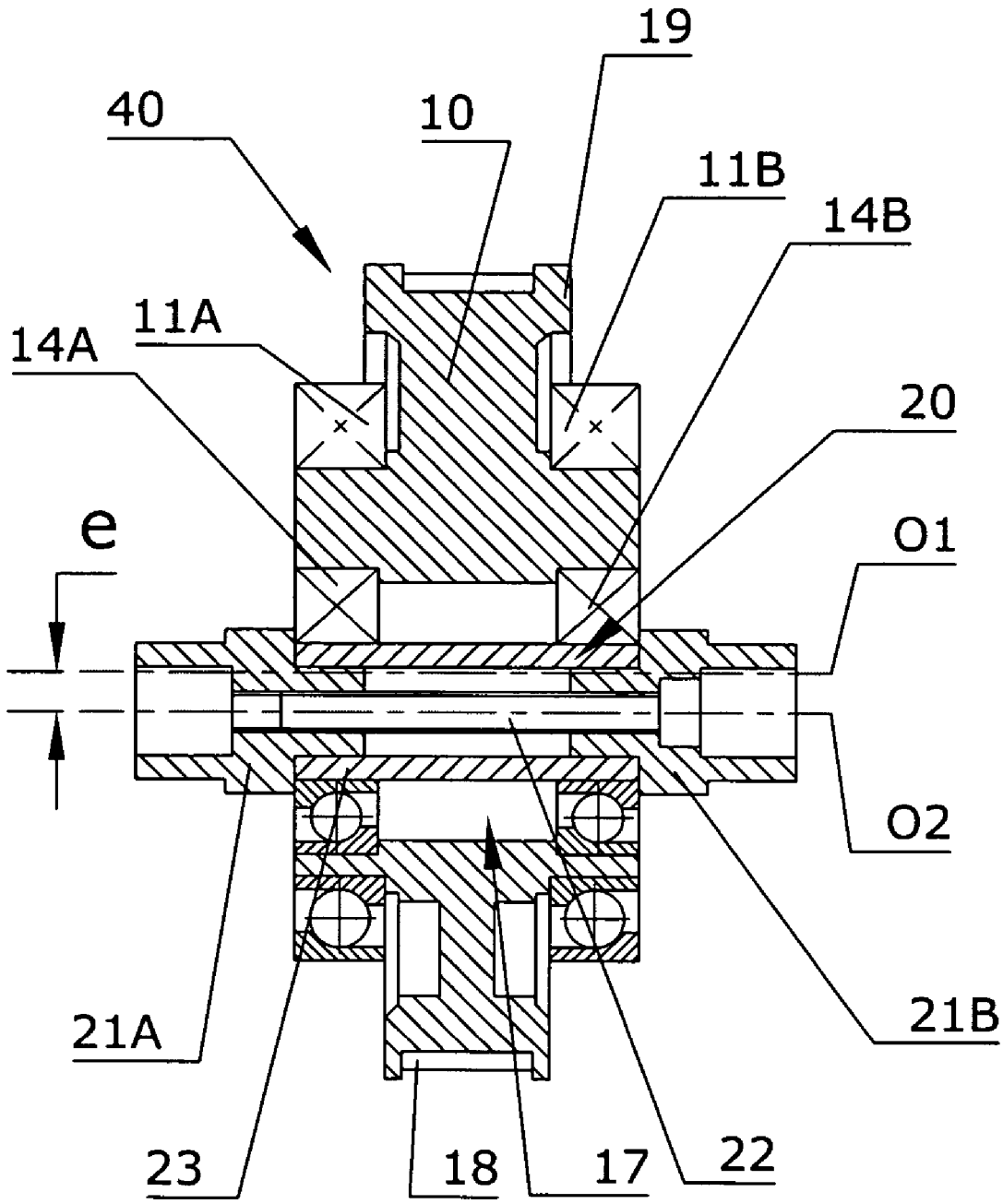
FIG. 12 is a schematic sectional view of an orbiting unit of the machine shown in FIG. 10.

FIG. 10 is a schematic sectional view of a scroll compressor according to the fourth embodiment of the present invention. FIG. 11 is the left view of the compressor excluding its left stationary scroll, left orbiting scroll, and left housing. FIG. 12 is a schematic sectional view of an orbiting unit of the compressor. As shown in FIGS. 10–12, a left housing 1A and a right housing 1B are mounted in a mirror-image relationship through screws 51. A left stationary scroll 2A is connected to the left housing 1A through screws 52A, and a right stationary scroll 2B is connected to the right housing 1B through screws 52B. The two housings 1A and 1B and the two stationary scrolls 2A and 2B compose the fixed structure of this machine. The two stationary scrolls 2A and 2B comprise, respectively, their own end plates 7A and 7B and spiral wraps 9A and 9B extending from the corresponding end plates 7A and 7B. The compressor includes two suction ports 4A and 4B that are connected, and two discharge ports 5A and 5B that are connected. Two orbiting scrolls 3A and 3B comprise, respectively, their own end plates 8A and 8B and spiral wraps 6A and 6B extending from the corresponding end plates 8A and 8B. Furthermore, the directions of the spiral wraps 6A and 6B should be arranged in a mirror-image relationship, and the directions of the spiral wraps 9A and 9B should be arranged in a mirror-image relationship. Two orbiting units 40 are mounted between the two orbiting scrolls 3A and 3B. Each of the two orbiting units 40 comprises a rotating member 10 rotatably supported on the two housings 1A and 1B through two bearings 11A and 11B, and a thrust-canceling shaft 20 rotatably supported in the rotating member 10 by two bearings 14A and 14B. The rotating member 10 comprises a balancing weight 19, a synchronous pulley 18 located on the periphery of the rotating member 10, and an eccentric through-hole 17. The two thrust-canceling shafts 20 are fixed between the two orbiting scrolls 3A and 3B. Each thrust-canceling shaft 20 comprises a left end 21A, a right end 21B, a sleeve 23, and a bearing pre-loading screw 22. The length of the sleeve 23 should be set such that the two ends 21A and 21B contact the sleeve 23 with proper preload when the bearings 14A and 14B are properly pre-loaded by the bearing pre-loading screw 22. The synchronous pulleys 18 are driven by a synchronous pulley 31 of a motor 30. A pre-tensioning pulley 32 is used to increase the wrap angle on the two synchronous pulleys 18 and the pulley 31 of the motor 30 and to apply proper pre-tension to a synchronous belt 33. The rotating axis O2 of the thrust-canceling shaft 20 is eccentric from the rotating axis O1 of the rotating member 10 with a distance of e. As shown in FIG. 11, O1-O2-O2-O1 forms a parallelogram linkage. The two orbiting units 40 plus the synchronous belt 33 form an anti-self-rotating mechanism. The orbiting scrolls 3A and 3B can get a more even driving force from the two orbiting units, and this makes the operation of the machine smoother and more reliable. The volumes formed by the spiral wraps 9A, 9B and 6A, 6B of the stationary scrolls 2A and 2B and the orbiting scrolls 3A and 3B change continuously when the orbiting scrolls 3A and 3B orbit. Fluid introduced through the suction ports 4A and 4B is continuously compressed, and discharged through the discharge ports 5A and 5B. During the process of compression, the fluid generates thrusting force exerted on the end plates 8A and 8B of the orbiting scrolls 3A and 3B. Most of the thrusting force is canceled through the two thrust-canceling shafts 20, and the rest is withstood by the bearings 11A, 11B, 14A, and 14B in the orbiting units 40. The frictional consumption of power is reduced because of the cancellation of the axial thrusting force, resulting in a high efficiency.

Figure 13:
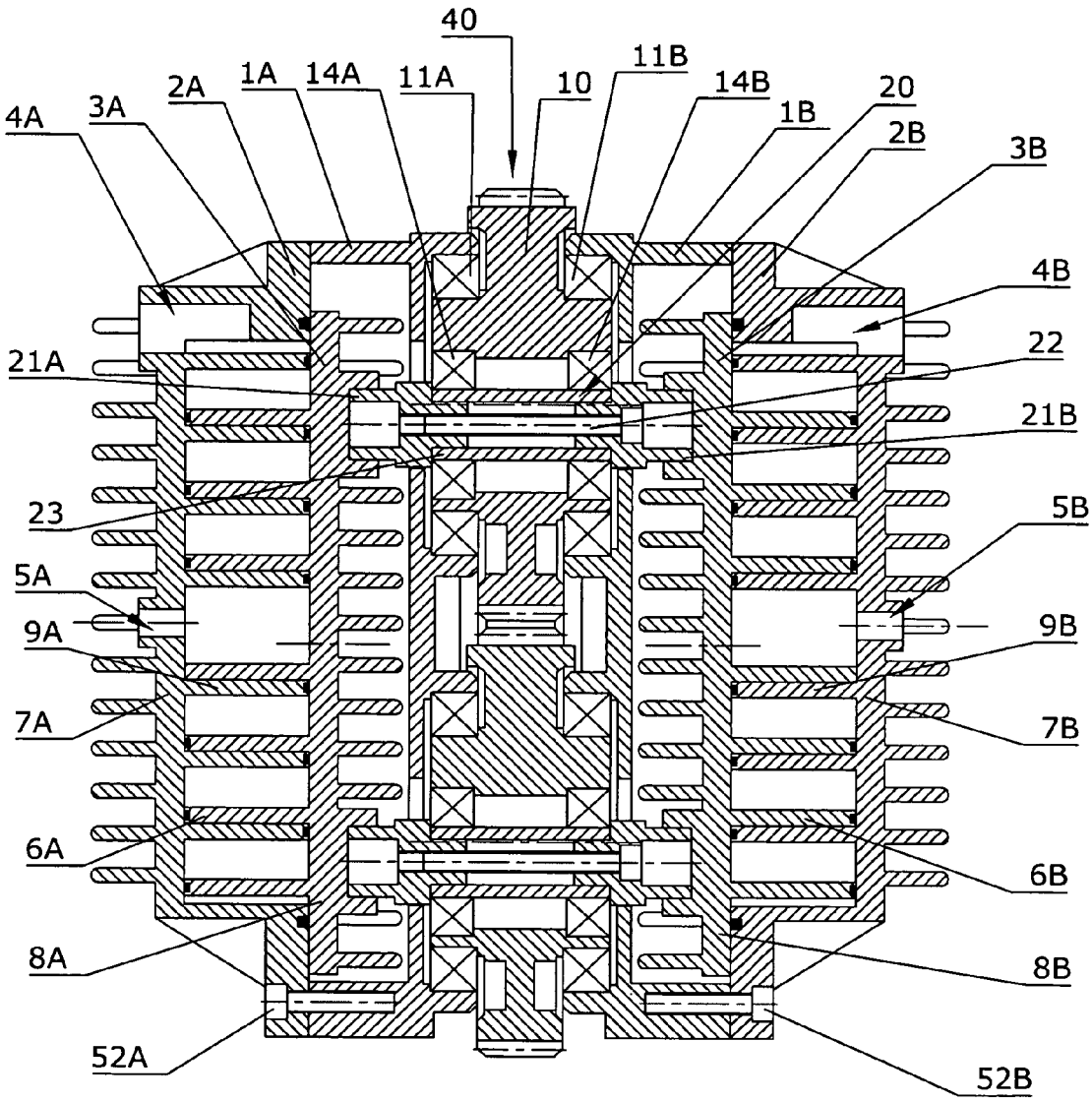
FIG. 13 is a schematic sectional view of a scroll compressor according to a fifth embodiment of the present invention.
Figure 14:
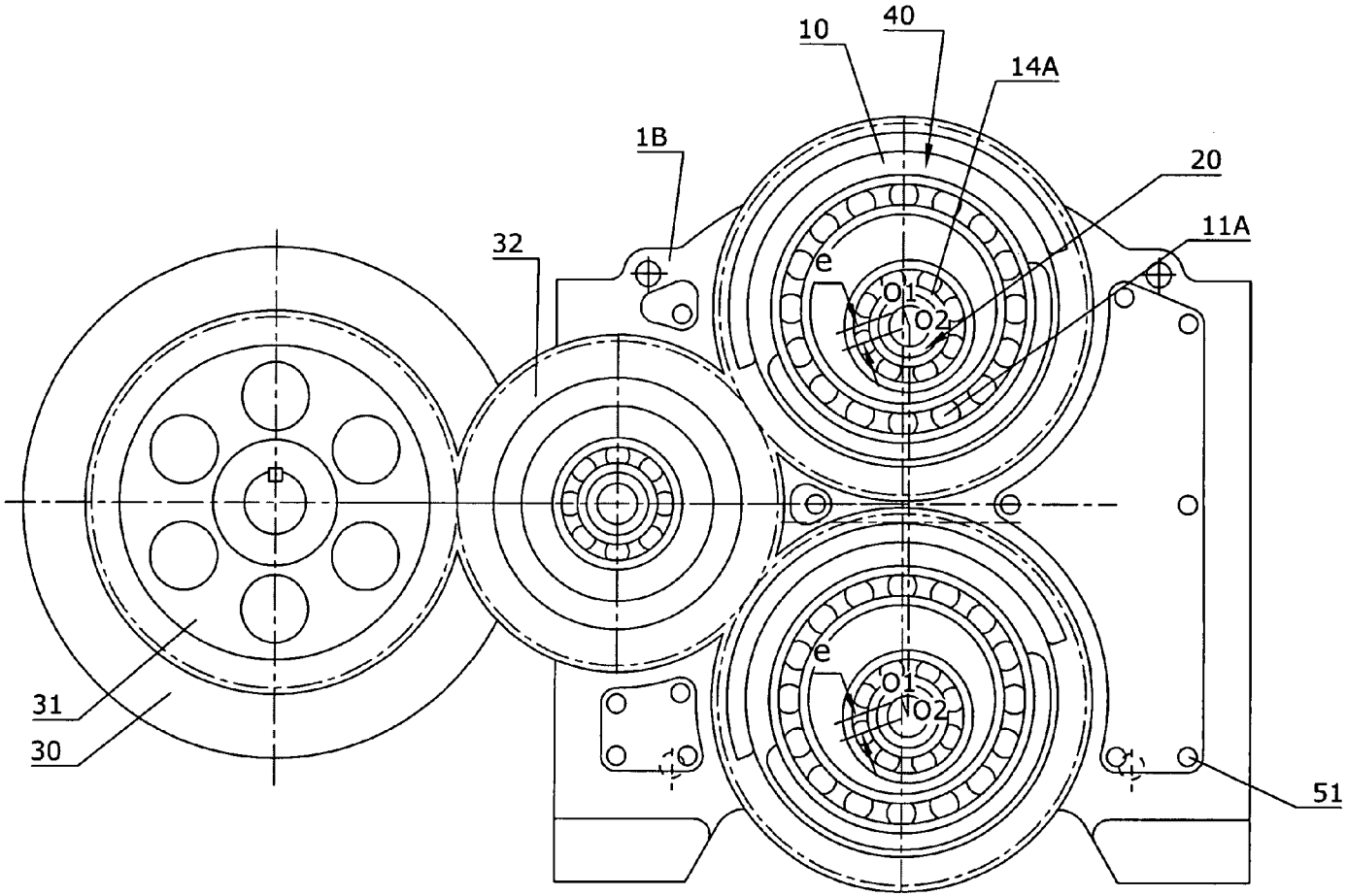
FIG. 14 is a left view of the machine shown in FIG. 13, excluding the left stationary scroll, left orbiting scroll, and left housing.
Figure 15:
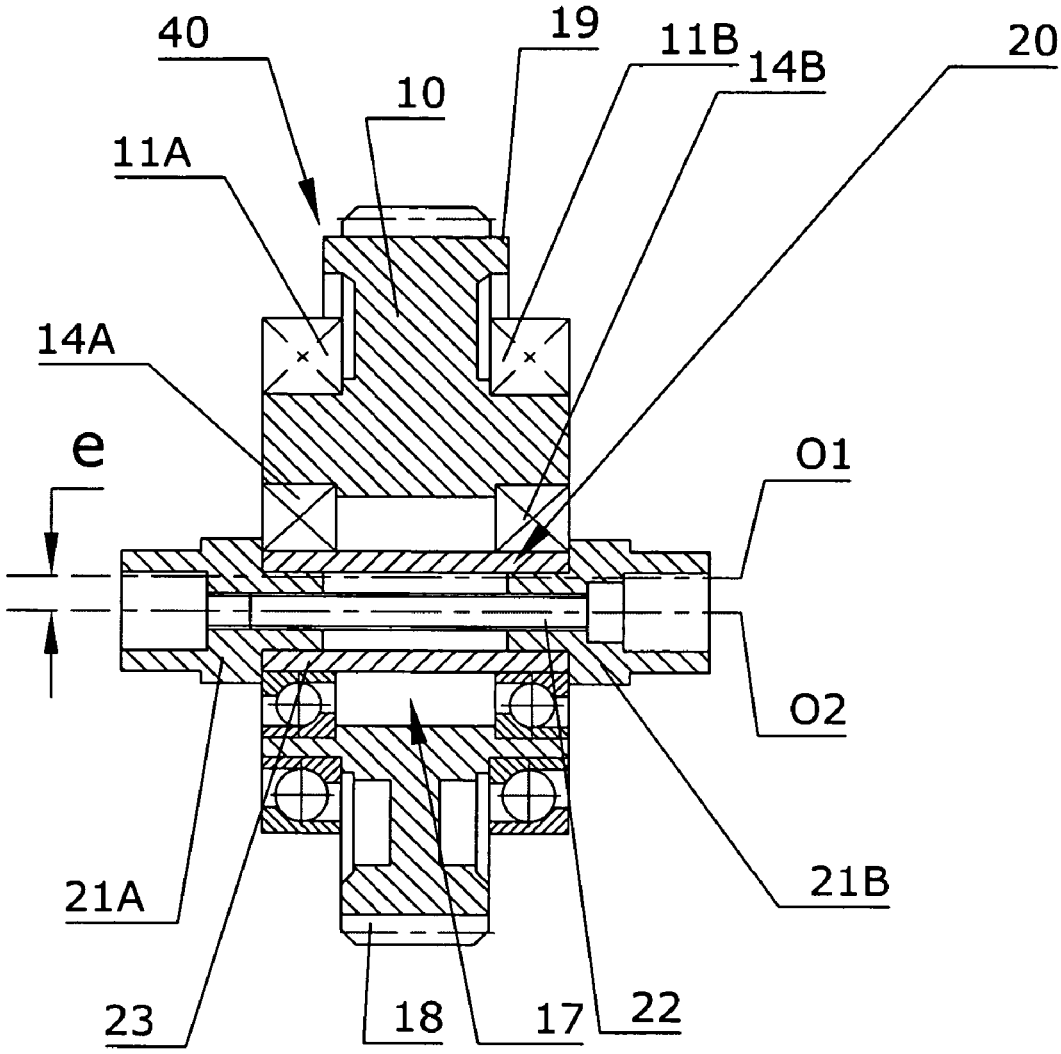
FIG. 15 is a schematic sectional view of an orbiting unit of the machine shown in FIG. 13.

FIG. 13 is a schematic sectional view of a scroll compressor according to the fifth embodiment of the present invention. FIG. 14 is the left view of the compressor, excluding its left stationary scroll, left orbiting scroll, and left housing. FIG. 15 is a schematic sectional view of an orbiting unit of the compressor. As shown in FIGS. 13–15, a left housing 1A and a right housing 1B are mounted in a mirror-image relationship through screws 51. A left stationary scroll 2A is connected to the left housing 1A through screws 52A, and a right stationary scroll 2B is connected to the right housing 1B through screws 52B. The two housings 1A and 1B and the two stationary scrolls 2A and 2B compose the fixed structure of this machine. The two stationary scrolls 2A and 2B comprise, respectively, their own end plates 7A and 7B and spiral wraps 9A and 9B extending from the corresponding end plates 7A and 7B. The compressor includes two suction ports 4A and 4B that are connected, and two discharge ports 5A and 5B that are connected. Two orbiting scrolls 3A and 3B comprise, respectively, their own end plates 8A and 8B and spiral wraps 6A and 6B extending from the corresponding end plates 8A and 8B. Furthermore, the directions of the spiral wraps 6A and 6B should be arranged in a mirror-image relationship, and the directions of the spiral wraps 9A and 9B should be arranged in a mirror-image relationship. Two orbiting units 40 are mounted between the two orbiting scrolls 3A and 3B. Each of the two orbiting units 40 comprises a rotating member 10 rotatably supported on the two housings 1A and 1B through two bearings 11A and 11B, and a thrust-canceling shaft 20 rotatably supported in the rotating member 10 by two bearings 14A and 14B. The rotating member 10 comprises a balancing weight 19, a gear 18 located on the periphery of the rotating member 10, and an eccentric through-hole 17. The two thrust-canceling shafts 20 are fixed between the two orbiting scrolls 3A and 3B. Each thrust-canceling shaft 20 comprises a left end 21A, a right end 21B, a sleeve 23, and a bearing pre-loading screw 22. The length of the sleeve 23 should be set such that the two ends 21A and 21B contact the sleeve 23 with proper preload when the bearings 14A and 14B are properly preloaded by the bearing pre-loading screw 22. The two gears 18 are driven by a gear 31 of a motor 30 through an idler gear 32. The rotating axis O2 of the thrust-canceling shaft 20 is eccentric from the rotating axis O1 of the rotating member 10 with a distance of e. As shown in FIG. 14, O1-O2-O2-O1 forms a parallelogram linkage. The two orbiting units plus the idler gear 32 form an anti-self-rotating mechanism. The orbiting scrolls 3A and 3B can get a more even driving force from the two orbiting units 40, and this makes the operation of the machine smoother and more reliable. The volumes formed by the spiral wraps 9A, 9B and 6A, 6B of the stationary scrolls 2A and 2B and the orbiting scrolls 3A and 3B change continuously when the orbiting scrolls 3A and 3B orbit. Fluid introduced through the suction ports 4A and 4B is continuously compressed, and discharged through the discharge ports 5A and 5B. During the process of compression, the fluid generates thrusting force exerted on the end plates 8A and 8B of the orbiting scrolls 3A and 3B. Most of the thrusting force is canceled through the two thrust-canceling shafts 20, and the rest is withstood by the bearings 11A, 11B, 14A, and 14B in the orbiting units 40. The frictional consumption of power is reduced because of the cancellation of the axial thrusting force, resulting in a high efficiency.

Figure 16:
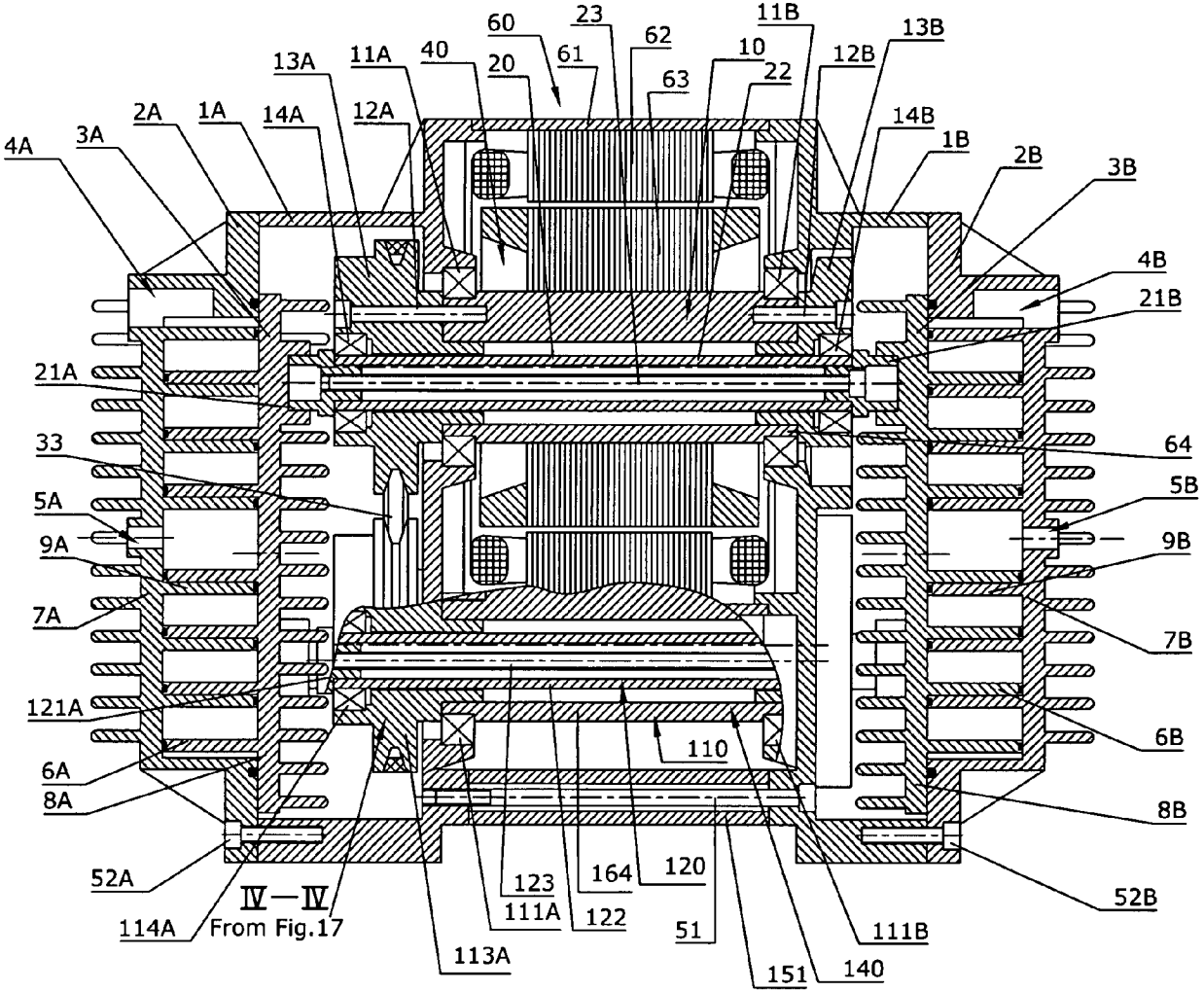
FIG. 16 is a schematic sectional view of a scroll compressor according to a sixth embodiment of the present invention.
Figure 17:
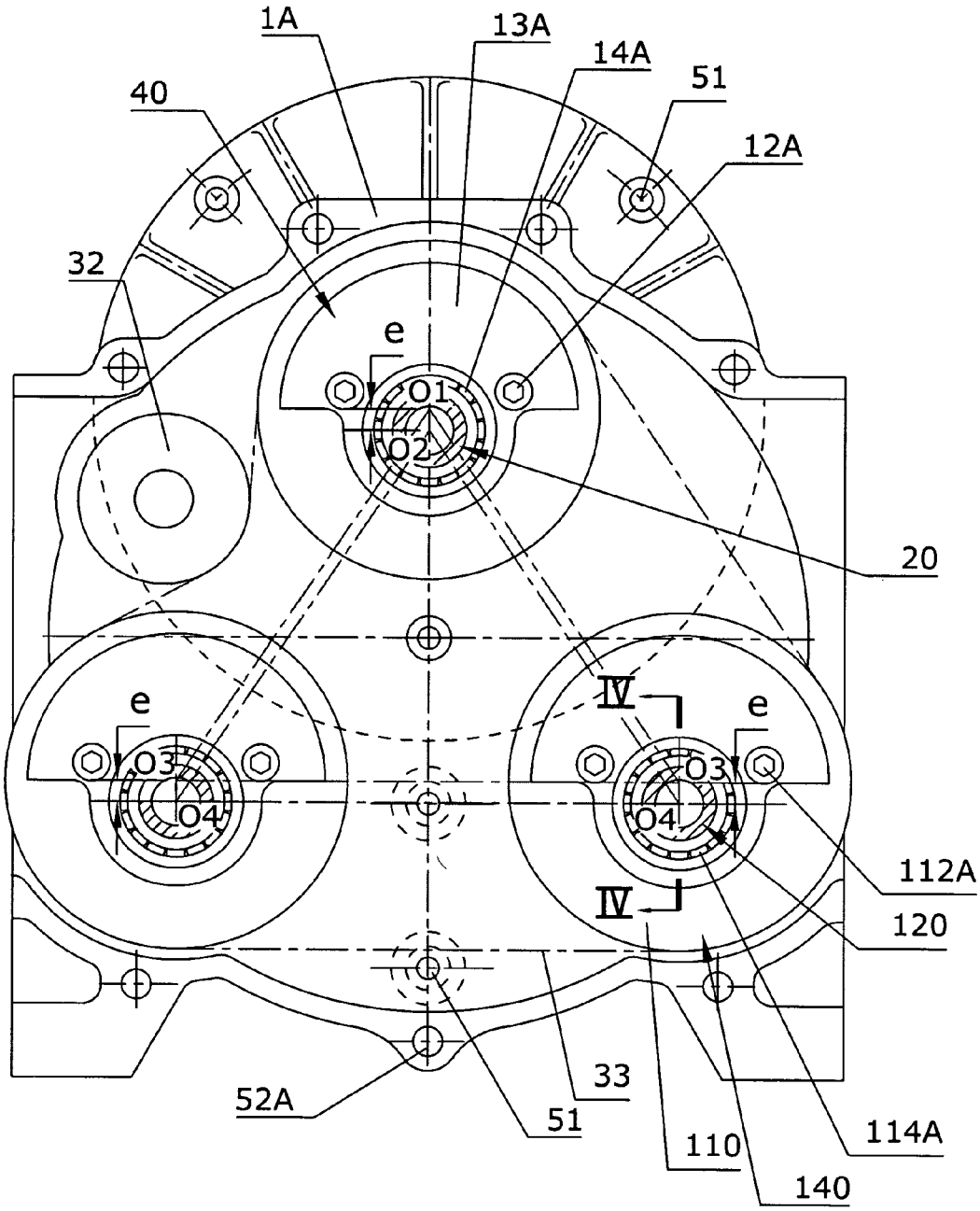
FIG. 17 is a left view of the machine shown in FIG. 16, excluding the left stationary scroll and left orbiting scroll.
Figure 18:
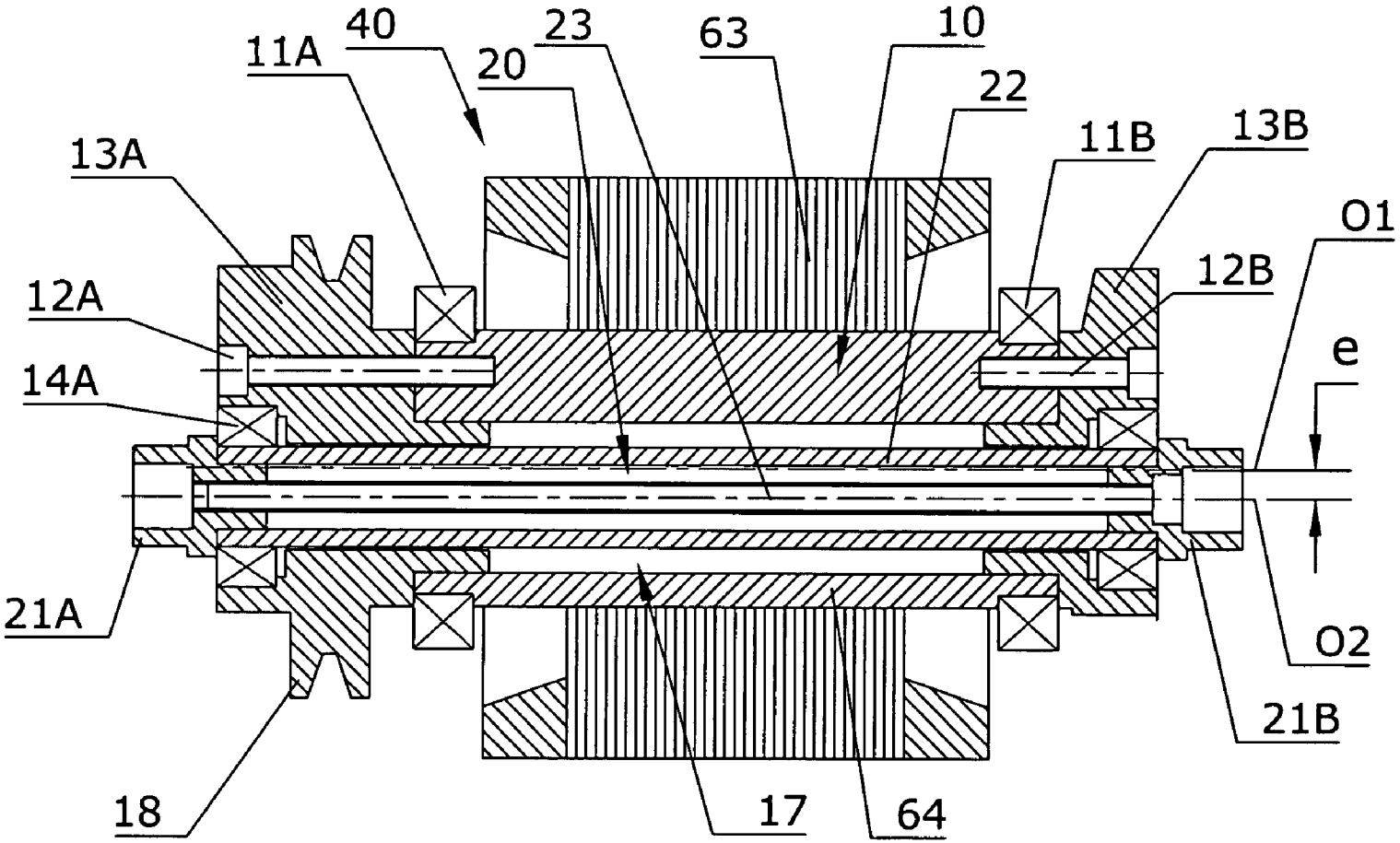
FIG. 18 is a schematic sectional view of the first orbiting unit of the machine shown in FIG. 16.
Figure 19:
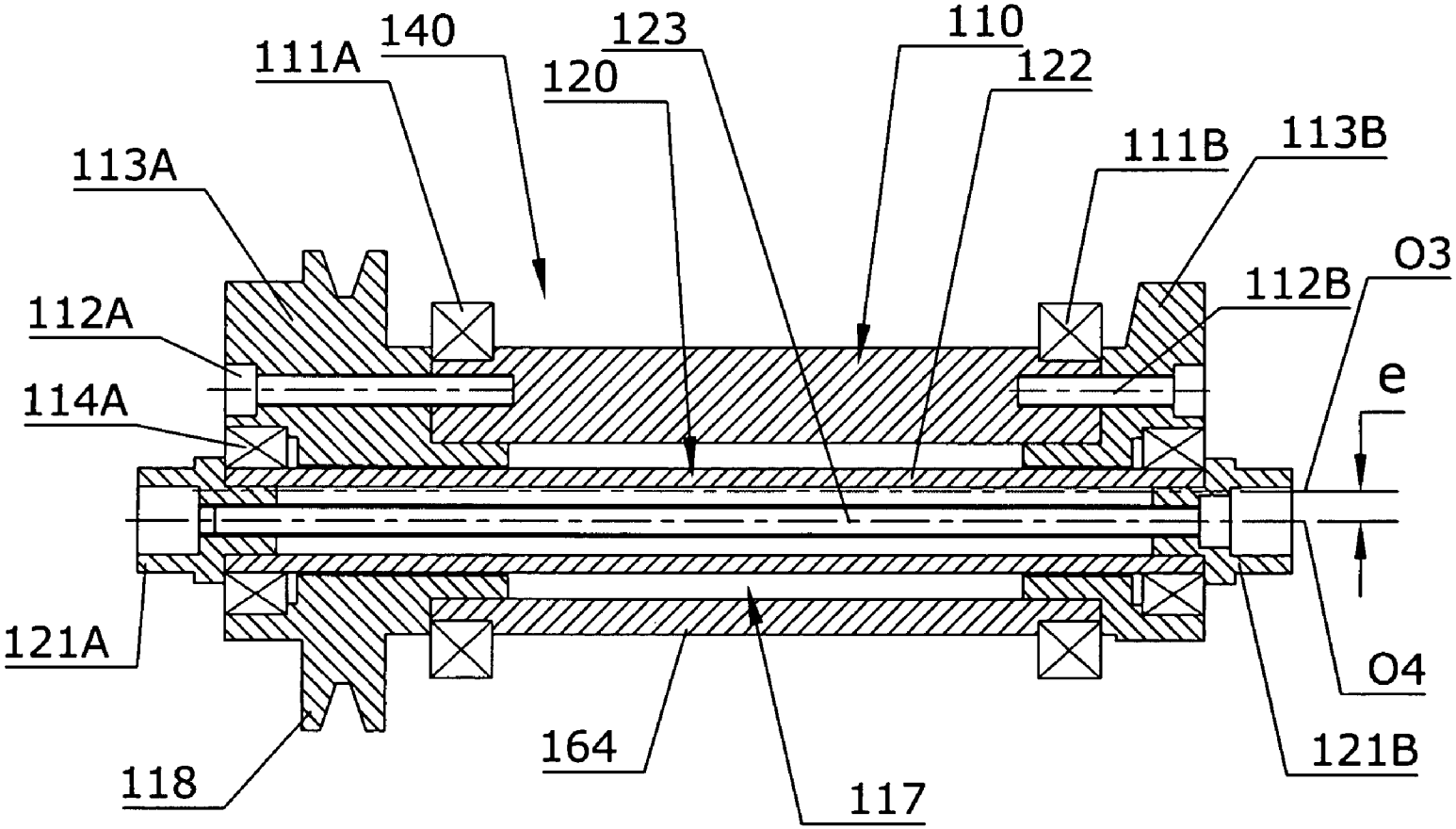
FIG. 19 is a schematic sectional view of the second/third orbiting unit of the machine shown in FIG. 16.

FIG. 16 is a schematic sectional view of a scroll compressor according to the sixth embodiment of the present invention. FIG. 17 is a left view of the compressor, excluding the left stationary scroll and left orbiting scroll. FIG. 18 is a schematic sectional view of its first orbiting unit 40. FIG. 19 is a schematic sectional view of its second/third orbiting unit 140. As shown in FIGS. 16–19, a shell 61 of a motor 60 and two mounting sleeves 151 are mounted between two housings 1A and 1B. A stator 62 is fixed in the shell 61. The left housing 1A and the right housing 1B are fixed through screws 51. The left housing 1A is connected to a left stationary scroll 2A through screw set 52A, and the right housing 1B is connected to a right stationary scroll 2B through screw set 52B. The two housings 1A and 1B, the two stationary scrolls 2A and 2B, the shell 61 with the stator 62, and the two mounting sleeves 151 compose the fixed structure of this machine. The two stationary scrolls 2A and 2B comprise, respectively, their own end plates 7A and 7B and spiral wraps 9A and 9B extending from the corresponding end plates 7A and 7B. The compressor includes two suction ports 4A and 4B that are connected, and two discharge ports 5A and 5B should be connected. Two orbiting scrolls 3A and 3B comprise, respectively, their own end plates 8A and 8B and spiral wraps 6A and 6B extending from the corresponding end plates 8A and 8B. Furthermore, the directions of the spiral wraps 6A and 6B should be arranged in a mirror-image relationship, and the directions of the spiral wraps 9A and 9B should be arranged in a mirror-image relationship. A first orbiting unit 40, a second and a third orbiting units 140 are mounted between the two orbiting scrolls 3A and 3B. The first orbiting unit 40, as shown in FIG. 18, comprises a first rotating member 10 rotatably supported on the two housings 1A and 1B through two bearings 11A and 11B, and a thrust-canceling shaft 20 rotatably supported in the first rotating member 10 by two bearings 14A and 14B. The first rotating member 10 comprises a first hollow shaft 64 with an eccentric through-hole 17, a motor rotor 63 fixed on the first hollow shaft 64, a left balancing weight 13A with a first pulley 18 fitted in the eccentric through-hole 17 through screws 12A, a right balancing weight 13B fitted in the eccentric through-hole 17 through screws 12B. The bearing 14A fitted in the left balancing weight 13A and the bearing 14B fitted in the right balancing weight 13B support the thrust-canceling shaft 20. The rotating axis O2 of the thrust-canceling shaft 20 has an eccentric distance e from the rotating axis O1 of the first rotating member 10. The thrust-canceling shaft 20 comprises a left end 21A, a right end 21B, a sleeve 23, and a bearing pre-loading screw 22. The length of the sleeve 23 should make the two ends 21A and 21B contact the sleeve 23 with proper preload when the bearings 14A and 14B are properly preloaded by the bearing pre-loading screw 22. The second/third orbiting unit 140, as shown in FIG. 19, comprises a second/third rotating member 110 rotatably supported on the two housings 1A and 1B through bearings 111A and 111B, and a thrust-canceling shaft 120 rotatably supported in the second/third rotating member 110 by bearings 114A and 114B. The second/third rotating member 110 comprises a second/third hollow shaft 164 with an eccentric through-hole 117, a left balancing weight 113A with a second/third pulley 118 fitted in the eccentric through-hole 117 through screws 112A, a right balancing weight 113B fitted in the eccentric through-hole 117 through screws 112B. The bearing 114A fitted in the left balancing weight 113A and the bearing 114B fitted in the right balancing weight 113B support the thrust-canceling shaft 120. The rotating axis O4 of the thrust-canceling shaft 120 has an eccentric distance e from the rotating axis O3 of the second/third rotating member 110. Each thrust-canceling shaft 120 comprises a left end 121A, a right end 121B, a sleeve 123, and a pre-loading screw 122. The length of the sleeve 123 should make the two ends 121A and 121B contact sleeve 123 with proper pre-load. As shown in FIG. 17, the triangle defined by O1-O3-O3 is identical to the triangle defined by O2-O4-O4. The first orbiting unit 40 and the second and the third orbiting units 140, the two orbiting scrolls 3A and 3B, and the two housings 1A and 1B compose three parallelogram linkages which form an anti-self-rotating mechanism. The volumes formed by the spiral wraps 9A, 9B and 6A, 6B of the stationary scrolls 2A and 2B and the orbiting scrolls 3A and 3B change continuously when the orbiting scrolls 3A and 3B orbit. Fluid introduced through the suction ports 4A and 4B is continuously compressed, and discharged through the discharge ports 5A and 5B. During the process of compression, the fluid generates thrusting force exerted on the end plates 8A and 8B of orbiting scrolls 3A and 3B. Most of the thrusting force is canceled through the thrust-canceling shafts 20 and 120, and the rest is withstood by the bearings 11A, 11B, 14A, and 14B in the first orbiting unit 40 and the bearings 111A, 111B, 114A, and 114B in the second and third orbiting units 140. The frictional consumption of power is reduced because of the cancellation of the axial thrusting force, resulting in a high efficiency.

In some embodiments of the present invention, all orbiting units are used to transmit driving force and to form parallelogram linkage mechanisms. In general, not all orbiting units are necessarily involved in the transmission of driving force. In fact, it is possible to use other methods to transmit driving force without any of the orbiting units involved.

Figure 20:
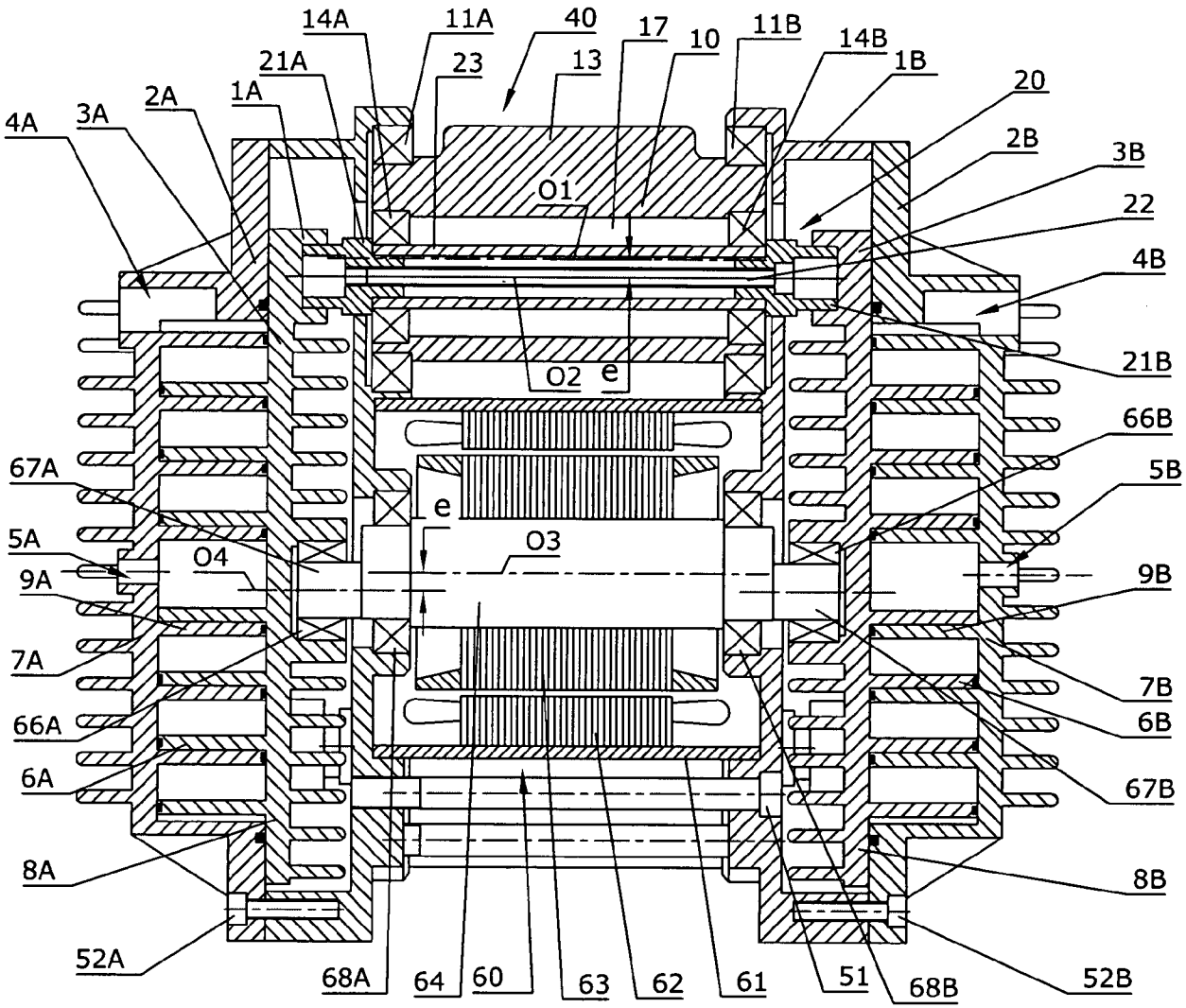
FIG. 20 is a schematic sectional view of a scroll compressor according to a seventh embodiment of the present invention.
Figure 21:
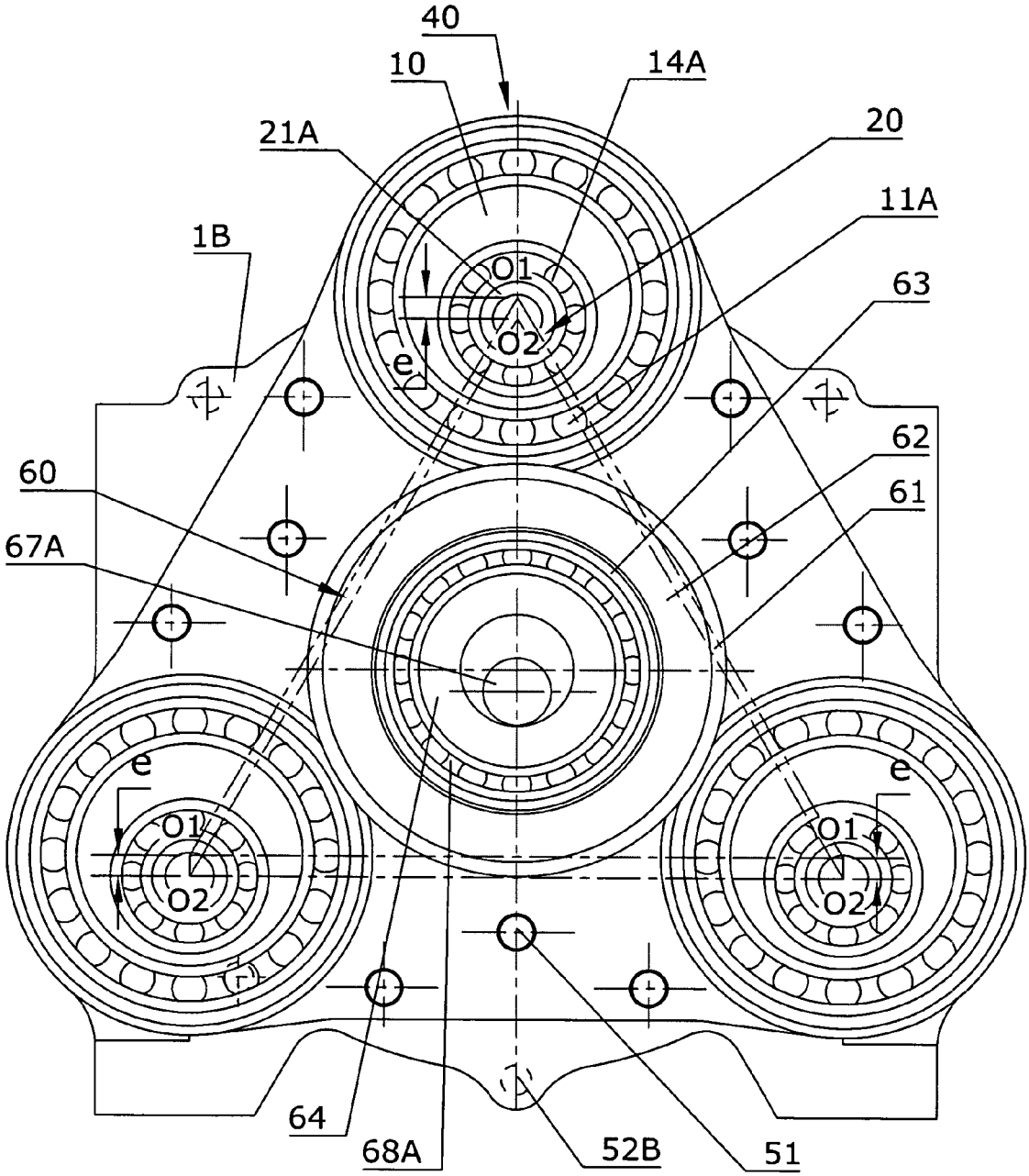
FIG. 21 is a left view of the machine shown in FIG. 20, excluding the left stationary scroll, left orbiting scroll, and left housing.

FIG. 20 is a schematic sectional view of a scroll compressor according to the seventh embodiment of the present invention. FIG. 21 is a left view of the compressor, excluding the left stationary scroll, left orbiting scroll, and left housing. As shown in FIGS. 20 and 21, a shell 61 of a motor 60 is mounted between two housings 1A and 1B. A stator 62 is fixed in the shell 61. The left housing 1A and the right housing 1B are fixed through screws 51. The left housing 1A is connected to a left stationary scroll 2A through screw set 52A, and the right housing 1B is connected to a right stationary scroll 2B through screw set 52B. The two housings 1A and 1B, the two stationary scrolls 2A and 2B, the shell 61 with the stator 62 compose the fixed structure of this machine. The two stationary scrolls 2A and 2B comprise, respectively, their own end plates 7A and 7B and spiral wraps 9A and 9B extending from the corresponding end plates 7A and 7B. The compressor includes two suction ports 4A and 4B that are connected, and two discharge ports 5A and 5B that are connected. Two orbiting scrolls 3A and 3B comprise, respectively, their own end plates 8A and 8B and spiral wraps 6A and 6B extending from the corresponding end plates 8A and 8B. Furthermore, the directions of the spiral wraps 6A and 6B should be arranged in a mirror-image relationship, and the directions of the spiral wraps 9A and 9B should be arranged in a mirror-image relationship. Three orbiting units 40 are mounted between the two orbiting scrolls 3A and 3B. Each of the three orbiting units 40 comprises a rotating member 10 rotatably supported on the two housings 1A and 1B through two bearings 11A and 11B, and a thrust-canceling shaft 20 rotatably supported in the eccentric through-hole 17 of the rotating member 10 by two bearings 14A and 14B. The rotating member 10 is formed together with a balancing weight 13. The rotating axis O2 of the thrust-canceling shaft 20 has an eccentric distance e from the rotating axis O1 of the rotating member 10. The thrust-canceling shaft 20 comprises a left end 21A, a right end 21B, a sleeve 23, and a bearing pre-loading screw 22. The length of the sleeve 23 should make the two ends 21A and 21B contact the sleeve 23 with proper preload when the bearings 14A and 14B are properly preloaded by the bearing pre-loading screw 22. As shown in FIG. 21, the triangle defined by O1-O1-O1 is identical to the triangle defined by O2-O2-O2. The three orbiting units 40, the two orbiting scroll 3A and 3B, and the two housings 1A and 1B compose three parallelogram linkages that form an anti-self-rotating mechanism. A motor shaft 64 of the motor 60 is rotatably supported on the two housings 1A and 1B through two bearings 68A and 68B. A left crank portion 67A formed at one end of the motor shaft 64 for rotatably supporting the left orbiting scroll 3A though a bearing 66A, and a right crank portion 67B formed at the other end of the motor shaft 64 for rotatably supporting the right orbiting scroll 3B. A rotor 63 of the motor 60 fitted on the motor shaft 64. The rotating axis O4 of the two crank portions 67A and 67B has an eccentric distance e from the rotating axis O3 of the motor shaft 64. The volumes formed by the spiral wraps 9A, 9B and 6A, 6B of the stationary scrolls 2A and 2B and the orbiting scrolls 3A and 3B change continuously when the orbiting scrolls 3A and 3B orbit. Fluid introduced through the suction ports 4A and 4B is continuously compressed, and discharged through the discharge ports 5A and 5B. During the process of compression, the fluid generates thrusting force exerted on the end plates 8A and 8B of the orbiting scrolls 3A and 3B. Most of the thrusting force is canceled through the three thrust-canceling shafts 20, and the rest is withstood by the bearings 11A, 11B, 14A, and 14B in the orbiting units 40. The frictional consumption of power is reduced because of the cancellation of the axial thrusting force, resulting in a high efficiency.

In the embodiments described hereinbefore, the eccentric distances e of all the orbiting units or the crankshaft in an embodiment are substantially equal, and can be represented by:

$$e = \frac{p}{2} - t,$$

where p corresponds to the pitch of the scroll wraps and t is the wall thickness of each wrap.

Although in the foregoing embodiments, the present invention has been described using scroll compressors and scroll expanders as examples of scroll type fluid machinery, the present invention is not necessarily limited to the scroll compressor and scroll expander, but may also be widely applied to other scroll type fluid machinery, such as vacuum pumps, refrigerant compressors, etc.

Although in the foregoing embodiments, the scroll type fluid machinery comprises two fluid volume changing mechanisms arranged in a mirror-image relationship, the present invention is not necessarily limited to the described arrangement. For example, the two fluid volume changing mechanisms can be different from each other in dimensions.

Although in the foregoing embodiments, the scroll type fluid machinery comprises two fluid volume changing mechanisms having the same function, the present invention is not necessarily limited to the described usages. For example, one of the two fluid volume changing mechanisms can be used as a compression mechanism while the other used as an expansion mechanism.

Although in the foregoing embodiments, the two suction ports are arranged to be connected and the two discharge ports are also arranged to be connected, it should be noted that the present invention is not necessarily limited to the described arrangement. For example, the discharge port of the first fluid volume changing mechanism is connected to the suction port of the second fluid volume changing mechanism.

Figure 22:
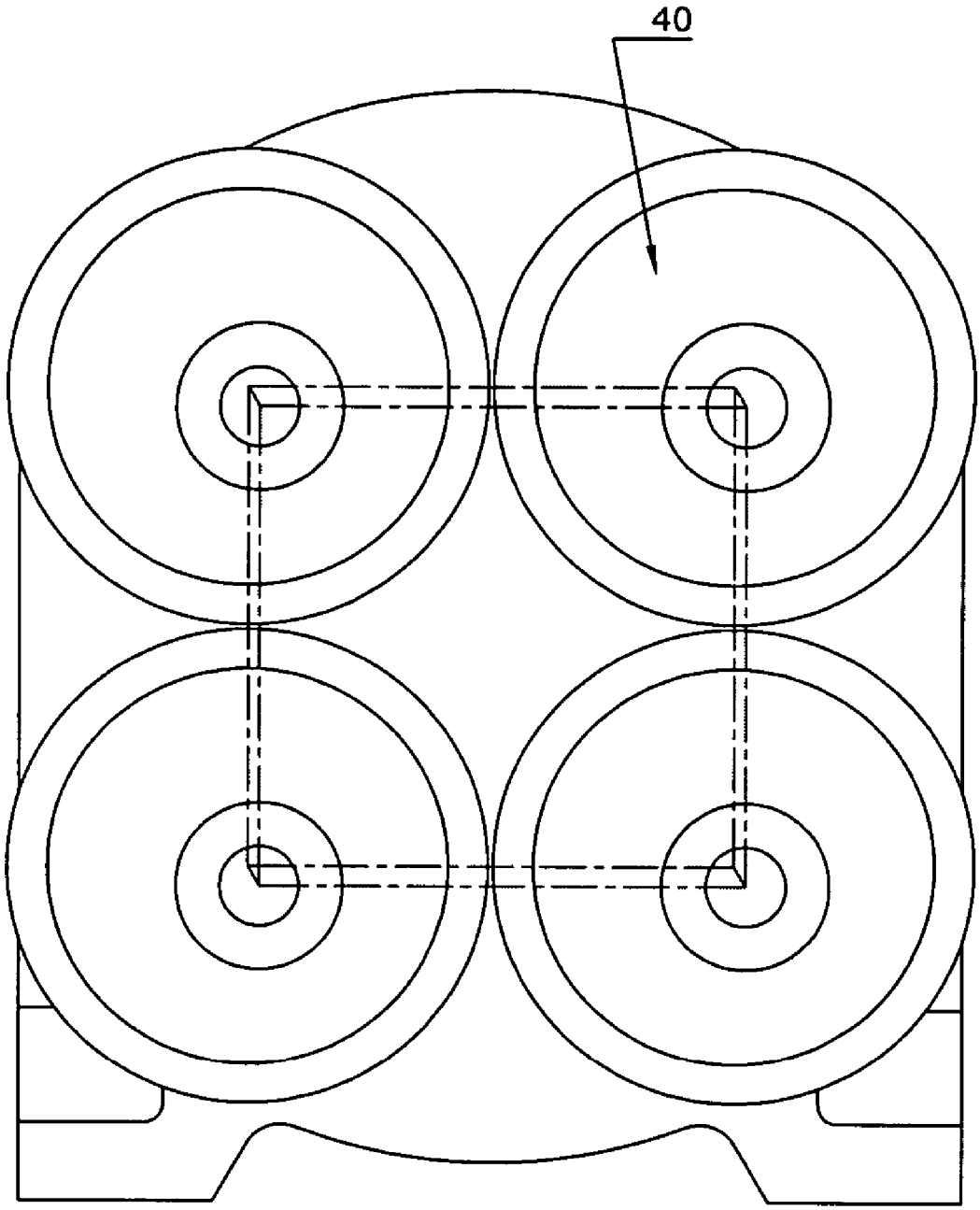
FIG. 22 is a schematic drawing of an embodiment having four orbiting units.

Although in the foregoing embodiments, two or three orbiting units are arranged in a machine, the present invention is not necessarily limited to the number of the orbiting units. Four or more orbiting units can be arranged in a machine. For example, an embodiment containing four orbiting units 40 is shown in FIG. 22.

Although in the foregoing embodiments, two housings are provided to a machine, the present invention is not necessarily limited to the described number of housings or the structure details shown in the drawings. For example, the two housings can be combined to form one body. Those skilled in this art will recognize modifications of structure and the like which do not depart from the true scope of the invention.

Although a description for some common mechanical devices, such as tip seal, shaft seal, alignment pin, cooling fin structure, etc, is omitted in the foregoing embodiments, the present invention is not limited from their application.

Although in the foregoing embodiments, the peripheries of the rotating members are described to have the forms of pulleys, gears, etc, the present invention is not necessarily limited to the described forms.

Figure 23:
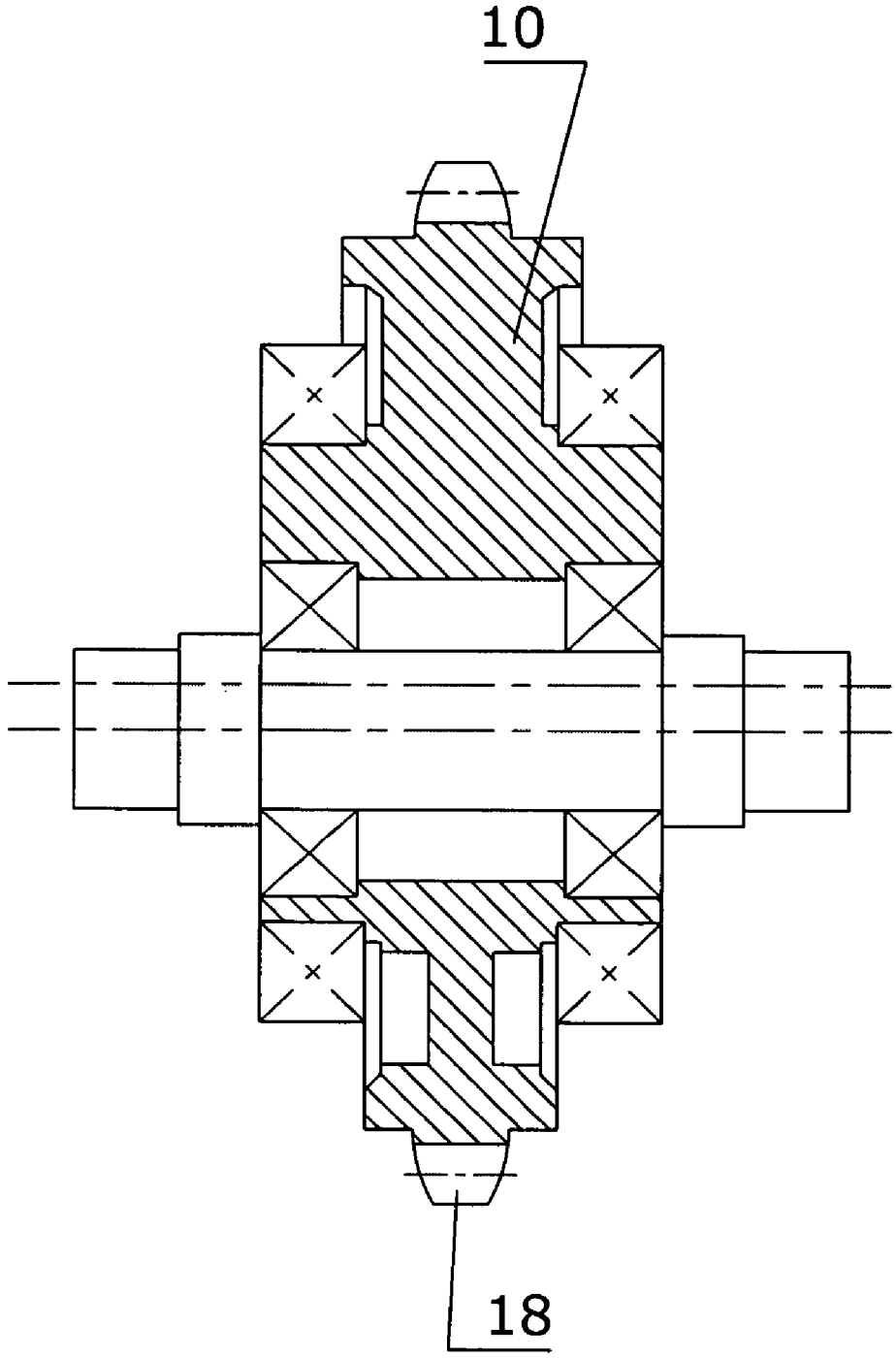
FIG. 23 is a schematic sectional drawing of an orbiting unit, with the periphery of the rotating member having the form of a sprocket.

The peripheries of the rotating members can have the forms of sprockets, cylinders, etc. For example, as show in FIG. 23, the periphery 18 of the rotating member 10 has the form of sprocket.

What we claim is:

1. A scroll type fluid machinery comprising:

a first fluid volume changing mechanism comprising a first stationary scroll and a first orbiting scroll, wherein the first orbiting scroll is associated with the first stationary scroll to allow the first orbiting scroll to orbit with respect to the first stationary scroll;

a second fluid volume changing mechanism comprising a second stationary scroll and a second orbiting scroll, wherein the second orbiting scroll is associated with the second stationary scroll to allow the first orbiting scroll to orbit with respect to the second stationary scroll; and a plurality of orbiting units, each of the orbiting units comprising:

a rotating member that is arranged to rotate relative to the first and second stationary scrolls, and a thrust-canceling shaft connected to the first orbiting scroll and to the second orbiting scroll, wherein the trust-canceling shaft is rotatably supported in a through-hole in the rotating member, which hole is eccentric relative to the axis of rotation of the rotating member, wherein the orbiting units are arranged to form one or more parallelogram linkages for preventing the first and second orbiting scrolls from self-rotation, and wherein at least one of the orbiting units is used to transmit a driving force to or from the first and the second fluid volume changing mechanisms.

2. The scroll type fluid machinery according to claim 1, wherein each orbiting unit is used to transmit a driving force to or from the first and the second fluid volume changing mechanisms.

3. The scroll type fluid machinery according to claim 1, wherein at least one of the outer peripheries of the rotating members of the orbiting units is a pulley.

4. The scroll type fluid machinery according to claim 1, wherein at least one of the outer peripheries of the rotating members of the orbiting units is a synchronous pulley.

5. The scroll type fluid machinery according to claim 1, wherein at least one of the outer peripheries of the rotating members of the orbiting units is a gear.

6. The scroll type fluid machinery according to claim 1, wherein at least one of the rotating members of the orbiting units is a rotor of a motor, and a stator of the motor is connected to the first and second stationary scrolls.

7. The scroll type fluid machinery according to claim 1, wherein at least one of the outer peripheries of the rotating members of the orbiting units is a sprocket.

8. The scroll type fluid machinery according to claim 1, wherein the number of the orbiting units is two.

9. The scroll type fluid machinery according to claim 8, further comprising a synchronous device that drivingly connects the rotating members of the two orbiting units.

10. The scroll type fluid machinery according to claim 9, wherein the outer peripheries of the rotating members of the two orbiting units are synchronous pulleys, and the synchronous device is a synchronous belt.

11. The scroll type fluid machinery according to claim 9, wherein the outer peripheries of the rotating members of the two orbiting units are first and second gears, and the synchronous device is a third gear engaged with the first and second gears.

12. The scroll type fluid machinery according to claim 11, further comprising a first housing and a second housing fixed to the first housing, wherein the first stationary scroll is fixed to the first housing, and the second stationary scroll is fixed to the second housing, and wherein the rotating members of the orbiting units are rotatably supported by the first and second housings.

13. The scroll type fluid machinery according to claim 12, wherein the two housings are formed together as one body.

14. The scroll type fluid machinery according to claim 1, wherein the number of the orbiting units is three.

15. The scroll type fluid machinery according to claim 14, wherein the outer peripheries of the rotating members of the three orbiting units are three pulleys being drivingly connected by a belt.

16. The scroll type fluid machinery according to claim 15, further comprising a tension pulley to increase the wrap angles of the belt on the three pulleys.

17. The scroll type fluid machinery according to claim 15, further comprising a first housing and a second housing fixed to the first housing, wherein the first stationary scroll is fixed to the first housing, and the second stationary scroll is fixed to the second housing, and wherein the rotating members of the orbiting units are rotatably supported by the first and second housings.

18. The scroll type fluid machinery according to claim 17, wherein the two housings are formed together as one body.

19. The scroll type fluid machinery according to claim 14, further comprising:

a motor having a rotor and a stator, wherein a first rotating member of the three orbiting units is connected to the rotor of the motor and has a first pulley, and the stator of the motor is connected to the first and second stationary scrolls, wherein a second rotating member of the three orbiting units has a second pulley, and wherein a third rotating member of the three orbiting units has a third pulley; and a belt drivingly connecting the first, second, and third pulleys.

20. The scroll type fluid machinery according to claim 1, wherein the rotating member of each orbiting unit has a balancing weight.

21. The scroll type fluid machinery according to claim 1, wherein the rotating member of each orbiting unit has two balancing weights, the two balancing weights fitted to a through-hole of the rotating member, each balancing weight has a hole with a diameter that is larger than that of the through-hole, two bearings fitted in the two holes of the two balancing weights to rotatably support the thrust-canceling shaft.

22. The scroll type fluid machinery according to claim 1, wherein the first and second fluid volume changing mechanisms are in a mirror-image relationship.

23. The scroll type fluid machinery according to claim 1, wherein each thrust-canceling shaft includes a sleeve, a first end at one end of the sleeve, a second end at the other end of the sleeve, and a bearing pre-loading screw, wherein the first and second ends are connected by the bearing pre-loading screw to pre-load two bearings that rotatably support the thrust-canceling shaft.

24. The scroll type fluid machinery according to claim 23, wherein the sleeve is in contact with the first and second ends under a predetermined pre-load.

25. The scroll type fluid machinery according to claim 1, further comprising a first housing and a second housing fixed to the first housing, wherein the first stationary scroll is fixed to the first housing, and the second stationary scroll is fixed to the second housing, and wherein the rotating members of the orbiting units are rotatably supported by the first and second housings.

26. The scroll type fluid machinery according to claim 25, wherein the two housings are formed together as one body.

* * * * *